US011402803B2

(12) United States Patent
Nakanishi et al.

(10) Patent No.: US 11,402,803 B2
(45) Date of Patent: Aug. 2, 2022

(54) TIMEPIECE AND INDICATING HAND CONTROL METHOD

(71) Applicant: SEIKO EPSON CORPORATION, Tokyo (JP)

(72) Inventors: Nobuhiko Nakanishi, Shiojiri (JP); Tadasuke Kotaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 620 days.

(21) Appl. No.: 16/286,820

(22) Filed: Feb. 27, 2019

(65) Prior Publication Data

US 2019/0265652 A1 Aug. 29, 2019

(30) Foreign Application Priority Data

Feb. 28, 2018 (JP) ..... JP2018-034337

(51) Int. Cl.
*G04B 47/06* (2006.01)
*G04B 19/04* (2006.01)

(52) U.S. Cl.
CPC ..... *G04B 47/066* (2013.01); *G04B 19/042* (2013.01); *G04B 47/065* (2013.01)

(58) Field of Classification Search
CPC .... G04B 47/06; G04B 47/061; G04B 47/063; G04B 47/065; G04B 47/066; G04B 19/042
See application file for complete search history.

(56) References Cited

U.S. PATENT DOCUMENTS 4,527,156 A * 7/1985 Nawrocki ..... G01R 13/02 345/204
5,550,794 A * 8/1996 Born ..... G04B 47/065 33/271
6,275,450 B1 8/2001 Makiba
7,869,308 B2 * 1/2011 Rochat ..... B63C 11/02 368/80
2007/0183263 A1 8/2007 Matthey
2007/0183264 A1 * 8/2007 Raeber ..... G04C 17/00 368/11
2007/0247291 A1 10/2007 Masuda et al.
2013/0233114 A1 9/2013 Matsuo et al.
2017/0254647 A1 9/2017 Nozawa
(Continued)

FOREIGN PATENT DOCUMENTS

JP S63-54025 U 4/1988
JP H07-298476 A 11/1995
JP 2007-526467 A 9/2007
(Continued)

*Primary Examiner* — Edwin A. Leon
*Assistant Examiner* — Jason M Collins
(74) *Attorney, Agent, or Firm* — Oliff PLC

(57) ABSTRACT

A timepiece includes a display unit including a first indicating hand and a dial so as to display a time, in which the dial has a first scale having a number for showing an absolute value of a positive numerical value within a plurality of numerical values indicated by the first indicating hand, a second scale having a number for showing an absolute value of a negative numerical value within the plurality of numerical values, a first sign for showing that the numerical value indicated by the first indicating hand is positive, and a second sign for showing that the indicated numerical value is negative.

11 Claims, 12 Drawing Sheets

(56) References Cited

U.S. PATENT DOCUMENTS

| | | | | |
|---|---|---|---|---|
| 2017/0285583 | A1* | 10/2017 | Iijima | G01C 5/06 |
| 2019/0120626 | A1 | 4/2019 | Nozawa | |

FOREIGN PATENT DOCUMENTS

| | | | |
|---|---|---|---|
| JP | 2007-298494 | A | 11/2007 |
| JP | 2013-184672 | A | 9/2013 |
| JP | 2013-213828 | A | 10/2013 |
| JP | 2017-161249 | A | 9/2017 |
| JP | 2017-161251 | A | 9/2017 |
| WO | 99/18479 | A1 | 4/1999 |

* cited by examiner

TIMEPIECE AND INDICATING HAND CONTROL METHOD

BACKGROUND

1. Technical Field

The present invention relates to a timepiece and an indicating hand control method.

2. Related Art

In recent years, an analog type timepiece for displaying a variation in an altitude is widely used. For example, JP-T-2007-526467 discloses a timepiece which displays the variation in the altitude within an instantaneous time such as 15 seconds or 30 seconds, and an average variation within a time such as 30 minutes. According to the timepiece, in response to a pressing operation of a crown, an hour hand and a minute hand indicate the variation in the altitude.

In a case where an indicating hand indicates a numerical value which is different from a time, such as a variation in an altitude while the time is continuously displayed, an hour hand and a minute hand need to indicate the variation in the altitude. Accordingly, a method disclosed in JP-T-2007-526467 cannot be used. Therefore, in order to indicate the numerical value which is different from the time by using the indicating hand while the time is continuously displayed, it is necessary to provide a first indicating hand which is different from the hour hand and the minute hand. However, since a main purpose of a timepiece is to display the time. Accordingly, if signs for showing whether the numerical values are positive or negative are respectively arranged without any change in addition to a plurality of numerical values indicated by the first indicating hand, the number of the numerical values or the signs to be arranged increases, thereby causing a problem in that legibility becomes poor.

SUMMARY

An advantage of some aspects of the invention is to improve legibility of a numerical value indicated by an indicating hand even in a case where times are continuously displayed in a timepiece.

A timepiece according to a preferred aspect (first aspect) of the invention includes a display unit including a first indicating hand and a first member so as to display a time. The first member has a first scale having a number for showing an absolute value of a positive numerical value within a plurality of numerical values indicated by the first indicating hand, a second scale having a number for showing an absolute value of a negative numerical value within the plurality of numerical values, one first sign for showing that the numerical value indicated by the first indicating hand is positive, and one second sign for showing that the indicated numerical value is negative.

According to the above-described aspect, each number of the first scale and each number of the second scale show the absolute value of the plurality of numerical values. The absolute value of the respective numerical values is not provided with a positive sign and a negative sign. Accordingly, the number of characters disposed inside the first member decreases. Therefore, the characters inside the first member can be easily viewed.

Furthermore, the first sign and the second sign are respectively disposed one by one. Accordingly, it is possible to easily read whether the numerical value shown by each number of the first scale and each number of the second scale is positive or negative.

According to this configuration, the character disposed inside the first member is easily viewed, and it is possible to easily read the plurality of numerical values indicated by each number of the first scale and each number of the second scale, that is, the first indicating hand. Accordingly, even in a case where times are continuously displayed, it is possible to improve legibility of the numerical value indicated by the first indicating hand.

In a preferred example (second aspect) of the first aspect, a shortest distance from the first scale to the first sign is shorter than a shortest distance from the first scale to the second sign, and a shortest distance from a second scale to the second sign is shorter than a shortest distance from the second scale to the first sign.

According to the above-described aspect, the shortest distance from the first scale to the first sign is shorter than the shortest distance from the first scale to the second sign. That is, compared to the second sign, the first sign is located closer to each number of the first scale. Therefore, even if each number of the first scale is not provided with the first sign, it is possible to indicate that the numerical value shown by each number of the first scale is positive. Based on a result that the numerical value shown by each number of the first scale is positive, a user can easily read that the numerical value shown by each number of the first scale is positive.

Similarly, the shortest distance from the second scale to the second sign is shorter than the shortest distance from the second scale to the first sign. That is, compared to the first sign, the second sign is located closer to each number of the second scale. Therefore, even if each number of the second scale is not provided with the second sign, it is possible to indicate that the numerical value shown by each number of the second scale is negative. Based on a result that the numerical value shown by each number of the second scale is negative, the user can easily read that the numerical value shown by each number of the second scale is negative.

In a preferred example (third aspect) of the first aspect and the second aspect, the timepiece further includes a barometric pressure sensor, and the first indicating hand indicates a variation per unit time in an altitude based on barometric pressure measured by the barometric pressure sensor by using the numerical value of the first scale or the numerical value of the second scale.

According to the above-described aspect, the user can easily read the numerical value shown by each number of the first scale and each number of the second scale. Accordingly, the user can easily read the variation per unit time in the altitude which is shown by the numerical value.

In a preferred example (fourth aspect) of the first aspect and the second aspect, the timepiece further includes a barometric pressure sensor, and the first indicating hand indicates the first sign in a case where a variation per unit time in barometric pressure measured by the barometric pressure sensor is positive, and indicates the second sign in a case where the variation is negative.

According to the above-described aspect, the user can easily read whether the variation per unit time in the barometric pressure which is shown by the first sign and the second sign is positive or negative.

In a preferred example (fifth aspect) of the first aspect to the fourth aspect, the first member has a fourth scale showing that one of the plurality of numerical values is 0, and in a plan view in an axial direction of an indicating hand axle of the first indicating hand, a number showing the absolute value of the plurality of numerical values is disposed line-symmetrically with respect to a virtual straight line passing through the indicating hand axle of the first indicating hand and the fourth scale.

In a general variometer, in a plan view in the axial direction of the indicating hand axle of the indicating hand inside the variometer, a number "0" showing 0 m/sec is located in a 9 o'clock direction. Numbers "1", "2", and "3" showing an ascent and numbers "−1", "−2", and "−3" showing a descent are disposed line-symmetrically with respect to the virtual straight line passing through the number "0" and the indicating hand axle of the indicating hand inside the variometer. An arrangement aspect of each number of the first scale and each number of the second scale according to the above-described aspect is the same as an arrangement aspect of the numbers inside the general variometer. Therefore, the user reads the first scale, the second scale, and the fourth scale. In this manner, the user can identify the numerical value through a using method the same as that of the general variometer.

In a preferred example (sixth aspect) of the first aspect to the fifth aspect, the display unit includes a second indicating hand and a third indicating hand, the first member has a fifth scale for showing a plurality of 10 power law exponents indicated by the second indicating hand, and a sixth scale for showing the plurality of numerical values indicated by the third indicating hand, and the third indicating hand indicates a value obtained by dividing a display target numerical value by the 10 power law exponents indicated by the second indicating hand, by using the numerical value of the sixth scale.

According to the above-described aspect, the 10 power law exponents indicated by the second indicating hand are properly changed. In this manner, it is possible to increase the numerical values to be displayed using the sixth scale.

In a preferred example (seventh aspect) of the first aspect to the fifth aspect, the timepiece further includes a sensor, the display unit includes a second indicating hand, a seventh scale for showing a plurality of time zones indicated by the second indicating hand, and an eighth scale for showing the plurality of numerical values indicated by the second indicating hand, the plurality of numerical values indicated by the second indicating hand are measurement results measured by the sensor, and in a plan view in an axial direction of an indicating hand axle of the second indicating hand, the eighth scale is disposed between the indicating hand axle of the second indicating hand and the seventh scale.

In general, the time zone is set in a case where the user travels across the time zone. The user does not frequently travels across the time zone. On the other hand, the measurement result measured by the sensor is displayed, for example, in a case where the altitude or the barometric pressure is displayed if the sensor is the barometric pressure sensor. Accordingly, the measurement result is displayed in a case where the user enjoys aerosports. For the above-described reasons, it can be considered that the seventh scale showing the plurality of time zones is much less frequently used than the eighth scale relating to the measurement result measured by the sensor. In the above-described aspect, the eighth scale is disposed between the indicating hand axle of the second indicating hand and the seventh scale. In other words, the seventh scale is disposed outside the eighth scale. Therefore, according to the above-described aspect, the seventh scale which is less frequently used is disposed outward, and the eighth scale which is more frequently used is disposed inward. In this manner, the user can easily read the numerical value of the eighth scale which is more frequently used.

In a preferred example (eighth aspect) of the first aspect to the sixth aspect, the timepiece further includes a sensor, and a lightness difference between a color of a number showing some of measurement results measured by the sensor in symbols disposed in the timepiece and a background color of the symbol is greater than a lightness difference between a color of the symbol relating to the time in the symbols and the background color.

In general, as the lightness difference increases between a foreground color and the background color, the user can more easily view the foreground color. If the measurement result and the time are compared with each other, the measurement result is more important information. According to the above-described aspect, the user can more easily view the number showing some measurement results which are more important than the time.

In a preferred example (ninth aspect) of the first aspect to the sixth aspect, the timepiece further includes a sensor, and a color difference between a color of a number showing some of measurement results measured by the sensor in symbols disposed in the timepiece and a background color of the symbols is greater than a color difference between a color of the symbol relating to the time in the symbols and the background color.

In general, as the color difference increases between the foreground color and the background color, the user can easily distinguish between the foreground color and the background color, and can more easily view the foreground color. According to the above-described aspects, the user can more easily view the number showing some measurement results which are more important than the time.

In a preferred example (tenth aspect) of the first aspect to the sixth aspect, the timepiece further includes a sensor, and a lightness difference between a color of a portion of the indicating hands relating to measurement results measured by the sensor in the indicating hands belonging to the timepiece and a background color of symbols disposed in the timepiece is greater than a lightness difference between a color of a portion of the indicating hands relating to the time in the indicating hands belonging to the timepiece and the background color.

According to the above-described aspects, the user can more easily view a portion of the indicating hand relating to the measurement result which is more important than the time.

In a preferred example (eleventh aspect) of the first aspect to the sixth aspect, the timepiece further includes a sensor, and a color difference between a color of a portion of the indicating hands relating to measurement results measured by the sensor in the indicating hands belonging to the timepiece and a background color of symbols disposed in the timepiece is greater than a color difference between a color of a portion of the indicating hands relating to the time in the indicating hands belonging to the timepiece and the background color.

According to the above-described aspects, the user can more easily view a portion of the indicating hand relating to the measurement result which is more important than the time.

An indicating hand control method according to a preferred aspect (twelfth aspect) of the invention is an indicating hand control method for controlling a timepiece including a display unit including a first indicating hand and a first member so as to display a time. The first member has a first scale having a number for showing an absolute value of a positive numerical value within a plurality of numerical values indicated by the first indicating hand, a second scale having a number for showing an absolute value of a negative numerical value within the plurality of numerical values, one first sign for showing that the numerical value indicated by the first indicating hand is positive, and one second sign for showing that the indicated numerical value is negative. In the indicating hand control method, in a case where the numerical value to be indicated is positive, the first indicating hand indicates the numerical value of the first scale. In a case where the numerical value to be indicated is negative, the first indicating hand indicates the numerical value of the second scale.

According to the above-described aspects, the user can easily view the character disposed inside the first member, and can easily read the plurality of numerical values indicated by the first indicating hand. Accordingly, even in a case where the times are continuously displayed, it is possible to improve legibility of the numerical value indicated by the first indicating hand.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the present invention will be described with reference to the drawings. However, in each drawing, a dimension and a scale of each portion are appropriately different from an actual dimension and an actual scale. The embodiments described below are preferable specific examples according to the invention. Accordingly, various technical limitations are given to the embodiments. The scale of the invention is not limited by the embodiments unless particularly limited in the following description.

A. Embodiment

Hereinafter, an electronic timepiece W (example of a "timepiece") according to the present embodiment will be described.

A.1. Overview of Electronic Timepiece W

Figure 1:
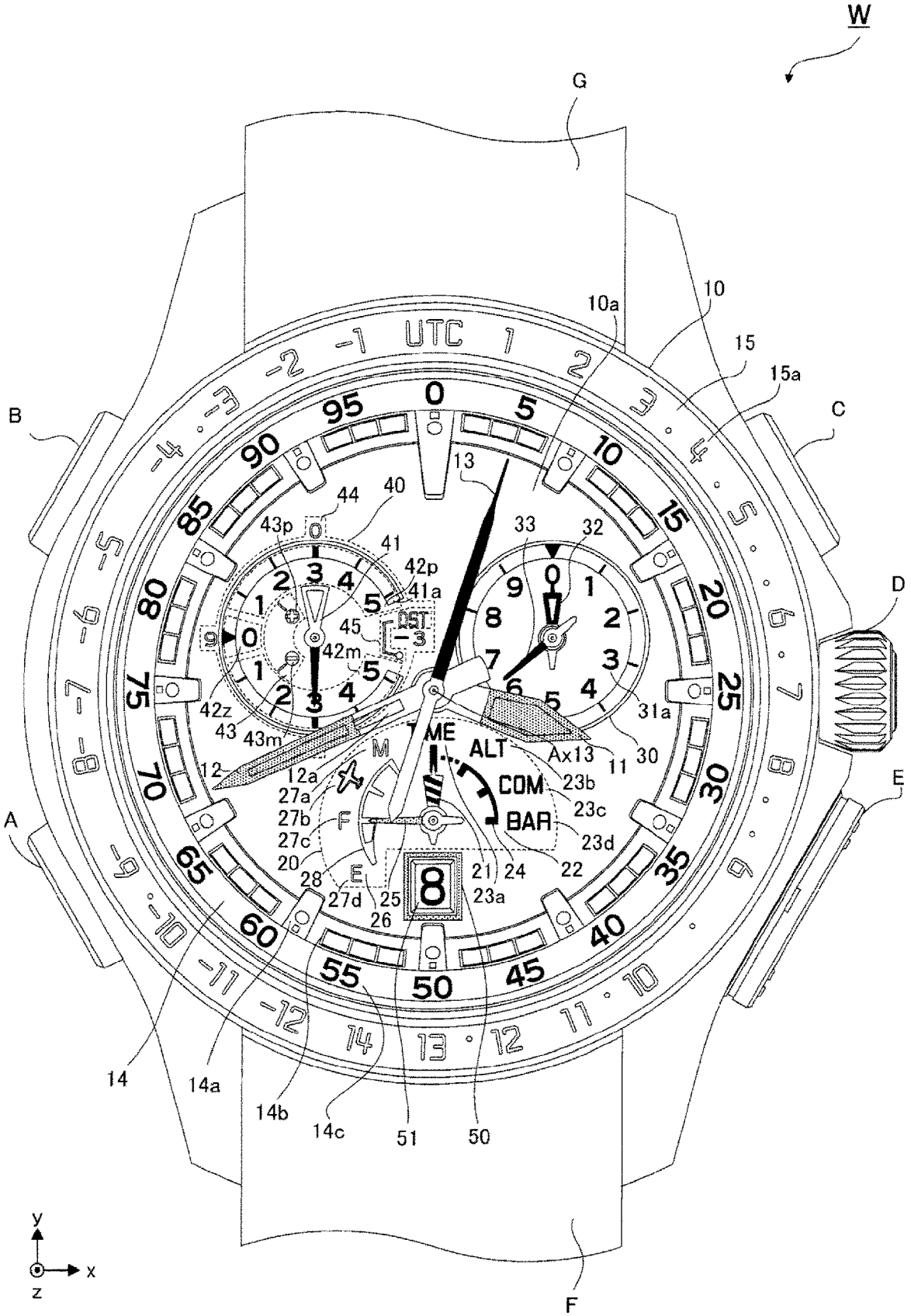
FIG. 1 is a plan view of an electronic timepiece.
Figure 2:
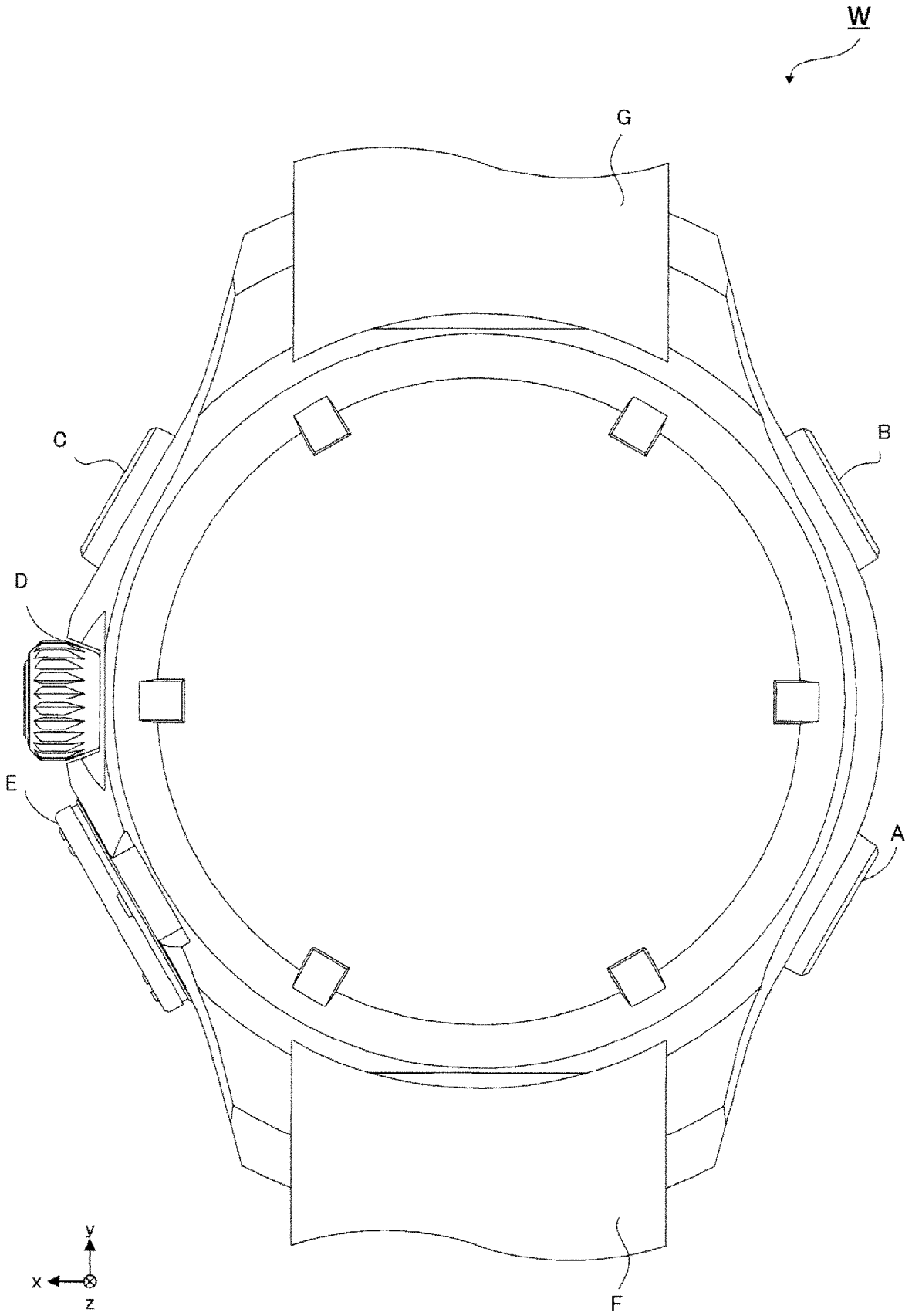
FIG. 2 is a bottom view of the electronic timepiece.
Figure 3:
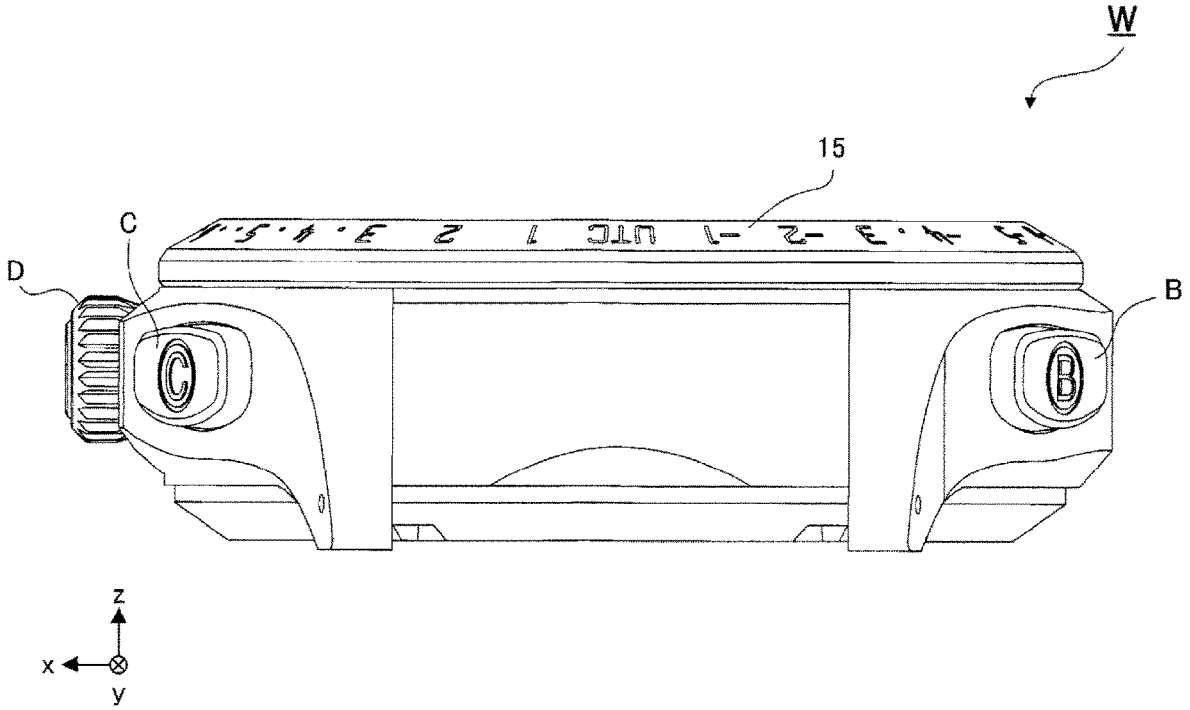
FIG. 3 is a front view of the electronic timepiece.
Figure 4:
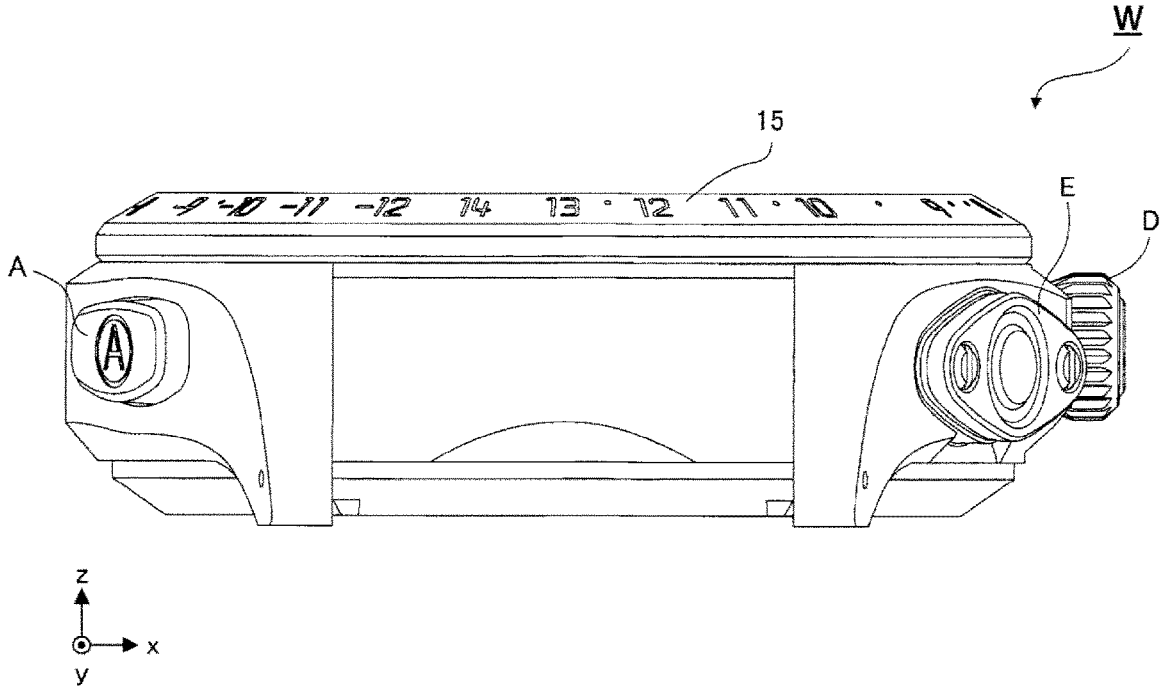
FIG. 4 is a rear view of the electronic timepiece.
Figure 5:
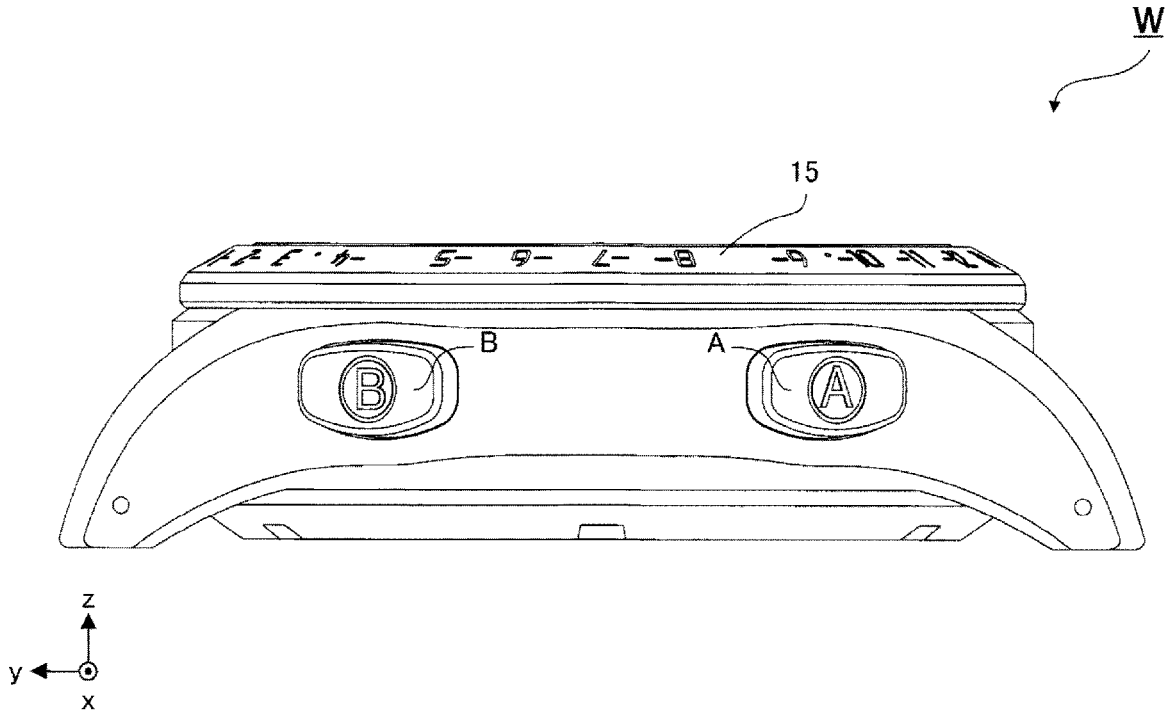
FIG. 5 is a left side view of the electronic timepiece.
Figure 6:
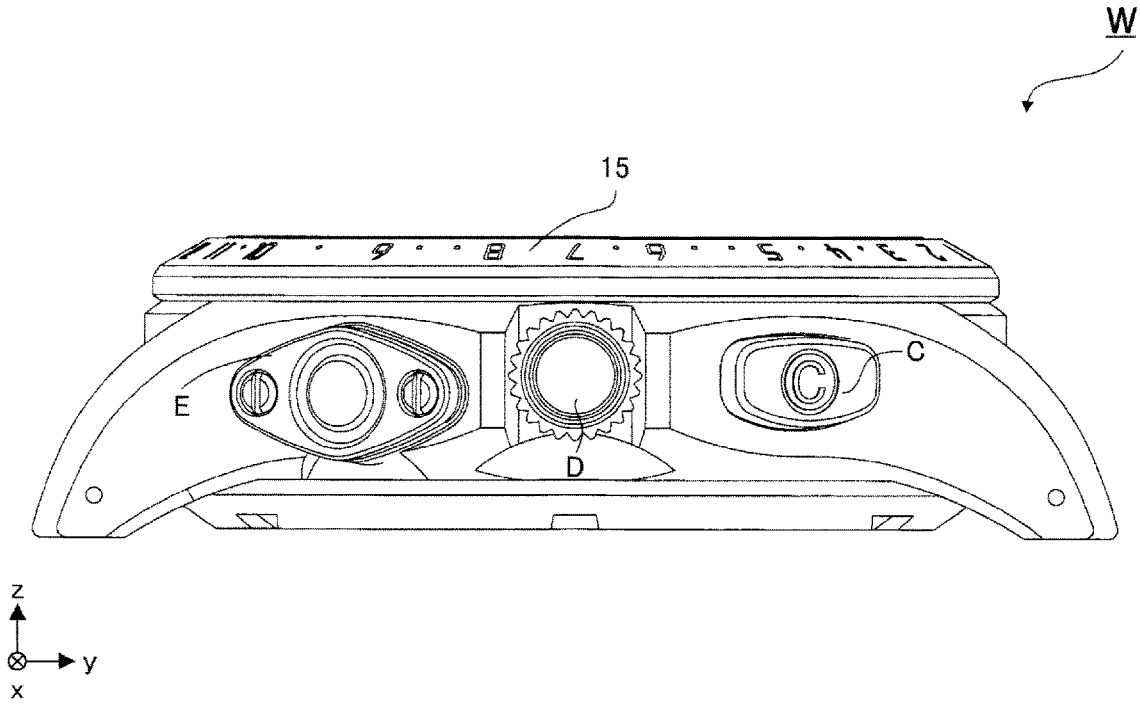
FIG. 6 is a right side view of the electronic timepiece.

FIGS. 1 to 6 illustrate a six-sided view of the electronic timepiece W according to the present embodiment. Specifically, FIG. 1 illustrates a plan view of the electronic timepiece W. FIG. 2 illustrates a bottom view of the electronic timepiece W. FIG. 3 illustrates a front view of the electronic timepiece W. FIG. 4 illustrates a rear view of the electronic timepiece W. FIG. 5 illustrates a left side view of the electronic timepiece W. FIG. 6 illustrates a right side view of the electronic timepiece W. The electronic timepiece W has an operation button A, an operation button B, an operation button C, a crown D, a barometric pressure sensor case E, a first band portion F, a second band portion G, and a display unit 10. As illustrated in FIG. 1, the electronic timepiece W is an analog type timepiece for displaying a time. In FIGS. 3 to 6, the first band portion F and the second band portion G are omitted in order to avoid the drawing from being complicated.

In FIG. 1, a direction from a rear surface to a front surface on a display surface of the display unit 10 is set as a positive direction of a z-axis. Two axes perpendicular to the z-axis are set as an xy-axis, and a direction from the center of the display unit 10 to the crown D is set as a positive direction of an x-axis. Alternatively, a normal direction of the display surface of the display unit 10 can be set as the z-axis, a direction from the center of the display surface to the first band portion F or the second band portion G can be set as a y-axis, and an axis perpendicular to the z-axis and the y-axis can be set as the x-axis. A direction from the first band portion F to the second band portion G, that is, a positive direction of the y-axis is defined as a "12 o'clock direction". Therefore, for example, a negative direction of the y-axis is a "6 o'clock direction", and a positive direction of the x-axis is a "3 o'clock direction". A coordinate system illustrated in FIG. 1 is a local coordinate system of the electronic timepiece W which illustrates coordinates based on the electronic timepiece W. If an orientation of the electronic timepiece W is changed, each orientation of the x-axis, the y-axis, and the z-axis is changed in accordance with a change in the orientation of the electronic timepiece W.

The operation button A, the operation button B, the operation button C, and the crown D are disposed on a side surface of the electronic timepiece W. As illustrated in FIGS. 4 and 5, a character "A" is marked on the operation button A. Similarly, as illustrated in FIGS. 3 and 5, a character "B" is marked on the operation button B. Similarly, as illustrated in FIGS. 3 and 6, a character "C" is marked on the operation button C. The operation button A, the operation button B, and the operation button C are described in a manual of the electronic timepiece W. A user can easily identify which operation button of the electronic timepiece W corresponds to the operation button described in the manual of the electronic timepiece W, by reading the character marked on the operation button A, the operation button B, and the operation button C.

The crown D is a member which can be rotated and pulled out. The barometric pressure sensor case E accommodates a barometric pressure sensor 4 (refer to FIG. 7). The first band portion F and the second band portion G are members for wearing the electronic timepiece W on a wrist of a user.

The display unit 10 has a dial 10*a* (example of a "first member"), an hour hand 11, a minute hand 12, a center indicating hand 13 (example of a "second indicating hand"), a dial ring 14, and a bezel 15. Furthermore, the display unit 10 has a 6 o'clock side information display unit 20 disposed on a 6 o'clock side, a 2 o'clock side information display unit 30 disposed on a 2 o'clock side, a 10 o'clock side information display unit 40 disposed on a 10 o'clock side, and a date display unit 50. The 6 o'clock side information display unit 20, the 2 o'clock side information display unit 30, and the 10 o'clock side information display unit 40 include a portion of the dial 10*a*. The date display unit 50 is disposed on the 6 o'clock side of the 6 o'clock side information display unit 20.

The minute hand 12 has a through-hole 12*a*. The through-hole 12*a* enables the user to easily view the character inside the 6 o'clock side information display unit 20, the 2 o'clock side information display unit 30, and the 10 o'clock side information display unit 40. Accordingly, it is possible to improve legibility. A scale 14*a* of a 12-hour system is annularly formed in the dial ring 14. Furthermore, a square 14*b* for showing numerical values of a hexadecimal number is located in the dial ring 14. Furthermore, in the dial ring 14, a scale 14*c* (example of an "eighth scale") for showing values of "0" to "95" is located as a plurality of numerical values. The hour hand 11, the minute hand 12, and the center indicating hand 13 can indicate the numerical value indicated by each of the scale 14*a*, the square 14*b*, and the scale 14*c*. For example, in an example illustrated in FIG. 1, the display unit 10 displays "3" by causing the center indicating hand 13 to indicate the square 14*b*, and displays "5" by causing the center indicating hand 13 to indicate the scale 14*c*.

The bezel 15 is a member for protecting and reinforcing the electronic timepiece W. Furthermore, the bezel 15 has a scale 15*a* (example of a "seventh scale") showing a plurality of time zones which can be indicated by the center indicating hand 13. For example, the scale 15*a* has a character string "UTC" showing a time zone having no time difference from the Coordinated Universal Time (UTC), a number "1" showing a time zone having a time difference of an hour earlier than the Coordinated Universal Time, and a number "−1" showing a time zone having a time difference of an hour later from the Coordinated Universal Time. A symbol "•" located between the two numbers located inside the scale 15*a* shows a time zone having a time difference between the time difference belonging to the time zone shown by one of the two numbers and the time difference belonging to the time zone shown by the other number. For example, the symbol "•" between a character "3" and a character "4" which are located inside the scale 15*a* shows a standard time of 3 hours 30 minutes earlier than the Coordinated Universal Time. Similarly, in two symbols "•" between a character "5" and a character "6" which are marked inside the bezel 15, the symbol "•" close to the character "5" shows a standard time of 5 hours 30 minutes earlier than the Coordinated Universal Time. The symbol "•" close to the character "6" shows a standard time of 5 hours 45 minutes earlier than the Coordinated Universal Time.

The 6 o'clock side information display unit 20 has a mode indicating hand 21, a scale 22, an indicator indicating hand 25, and a scale 26. In the scale 22, a character string showing an operation mode and a scale line 24 are marked. As the operation mode, the electronic timepiece W has a time display mode for displaying a current time, an elevation degree display mode for displaying a variation per unit time in an altitude (hereinafter, referred to as an "elevation degree") of the electronic timepiece W, a compass mode for displaying a north azimuth, and a barometric pressure display mode for displaying barometric pressure around the electronic timepiece W. The scale 22 is provided with a character string 23*a* "TIME" showing the time display mode, a character string 23*b* "ALT" showing the elevation degree display mode, a character string 23*c* "COM" showing the compass mode, and a character string 23*d* "BAR" showing the barometric pressure display mode.

The 6 o'clock side information display unit 20 displays that the operation mode is the time display mode by causing the mode indicating hand 21 to indicate the character string 23*a*. The 6 o'clock side information display unit 20 displays that the operation mode is the elevation degree display mode by causing the mode indicating hand 21 to indicate the character string 23*b*. The 6 o'clock side information display unit 20 displays that the operation mode is the compass display mode by causing the mode indicating hand 21 to indicate the character string 23*c*. The 6 o'clock side information display unit 20 displays that the operation mode is the barometric pressure display mode by causing the mode indicating hand 21 to indicate the character string 23*d*.

A.1.1. Overview of Time Display Mode

In the time display mode, the electronic timepiece W can display the current time. In a case where the operation button A is pressed several times by a user and the mode indicating hand 21 indicates the character string 23*a*, the electronic timepiece W sets the operation mode to the time display mode.

In a case where the operation mode is set to the time display mode, the display unit 10 uses the hour hand 11 and the minute hand 12 with reference to the scale 14*a* and the square 14*b*, and displays an hour and a minute of the current time. Furthermore, the display unit 10 causes the 10 o'clock side information display unit 40 to display a second of the current time.

The 10 o'clock side information display unit 40 has a small second hand 41 (example of a "first indicating hand"), a scale 42*p* (example of a "first scale"), a scale 42*m* (example of a "second scale), a scale 42*z* (example of a "fourth scale"), a scale 43 (example of a "third scale"), a scale 44 of a 12-hour system, and a scale 45. In the time display mode, the 10 o'clock side information display unit 40 displays the second of the current time by indicating the scale 44. In an example illustrated in FIG. 1, the 10 o'clock side information display unit 40 displays that the second of the current time is 30 seconds.

In the time display mode, if the crown D is operated and pulled out one step, the time zone can be set, and a daylight saving time can be set. Specifically, if the crown D is operated and pulled out one step, the center indicating hand 13 displays a current time zone by indicating the scale 15*a*, and the small second hand 41 indicates the scale 45 so as to display whether the daylight saving summer time is ON or OFF. The scale 45 is provided with a character string "DST (daylight saving time)" showing that the daylight saving time is ON, and a symbol "•" showing that the daylight saving time is OFF. After the crown D is operated and pulled out one step, if a rotation operation of the crown D is accepted, the center indicating hand 13 is rotated in response to the rotation operation of the crown D. After the crown D is operated and pulled out one step, if a pressing operation of the operation button C for a predetermined time is accepted (for example, 3 seconds) or longer, the small second hand 41 is rotated, and ON and OFF of the daylight saving time are switched therebetween. If the pressing operation of the crown D is accepted, the electronic timepiece W stores settings of the time zone and the daylight saving time in accordance with to each current orientation of the center indicating hand 13 and the small second hand 41.

If the pressing operation of the operation button B is performed in the time display mode, it is possible to display the number of satellites from which a global positioning system (GPS) receiver 2 (refer to FIG. 7) can receive satellite signals. Specifically, the small second hand 41 indicates the number of satellites from which the satellite signals can be received.

A.1.2. Overview of Elevation Degree Display Mode

In the elevation degree display mode, the electronic timepiece W can display the elevation degree. In a case where the operation button A is pressed several times by the user and the mode indicating hand 21 indicates the character string 23*b*, the electronic timepiece W sets the operation mode to the elevation degree display mode.

In a case where the operation mode is set to the elevation degree display mode, the 10 o'clock side information display unit 40 displays the elevation degree by using the small second hand 41, a ring disk 41*a*, the scale 42*p*, the scale 42*m*, the scale 42*z*, and the scale 43. The ring disk 41*a* is cut in a 3 o'clock direction. The scale 42*p*, the scale 42*m*, and the scale 42*z* show real numbers from −5 to 5 as a plurality of numerical values which can be indicated by the small second hand 41.

The scale 42*p* is provided with a number "1", a number "2", a number "3", a number "4", and a number "5" which show an absolute value of a positive numerical value out of the plurality of numerical values. The scale 42*m* is provided with a number "1", a number "2", a number "3", a number "4", and a number "5" which show an absolute value of a negative numerical value out of the plurality of numerical values. The scale 42*z* is provided with a number "0" showing that one of the plurality of numerical values is 0. The scale 43 is provided with a positive sign 43*p* (example of a "first sign") showing that the numerical value indicated by the small second hand 41 is positive, and a negative sign 43*m* (example of a "second sign") showing that the numerical value indicated by the small second hand 41 is negative. The positive sign 43*p* is a sign "+", and the negative sign 43*m* is a sign "−". The ring disk 41*a* is provided with a scale line corresponding to the number inside the scale 42*p*.

In the elevation degree display mode, each number of the scale 42*p*, each number of the scale 42*m*, and the number "0" of the scale 42*p* are used as one digit value of "m/sec" with respect to the small second hand 41. In the example illustrated in FIG. 1, the 10 o'clock side information display unit 40 displays that the elevation degree is −3 m/sec.

In the elevation degree display mode, a current elevation degree can be recorded as a log, the recorded log can be displayed, and the recorded log can be deleted. Specifically, the pressing operation of the operation button C is performed for a predetermined time or longer, thereby causing the electronic timepiece W to record the current elevation degree as the log. A log number is assigned to the recorded elevation degree. The pressing operation of the operation button B is performed. In this manner, the small second hand 41 indicates the scale 44 so as to display the log number. After the log number is displayed, the small second hand 41 indicates the elevation degree to which the displayed log number is assigned. After the log number is displayed, the pressing operation of the operation button B is performed for a predetermined time or longer. In this manner, the electronic timepiece W deletes the elevation degree to which the displayed log number is assigned.

A.1.3. Overview of Compass Mode

In the compass mode, the electronic timepiece W can indicate an azimuth of a geographical true north (hereinafter, simply referred to as a "true north"). In a case where the operation button A is pressed several times by the user and the mode indicating hand 21 indicates the character string 23*c*, the electronic timepiece W sets the operation mode to the compass mode.

In a case where the operation mode is set to the compass mode, based on the azimuth of a magnetic north measured by a triaxial magnetic sensor 3 (refer to FIG. 7), the display unit 10 controls the center indicating hand 13 so that the orientation of the center indicating hand 13 faces the true north. The azimuth of the magnetic north deviates as much as a deviation angle from the true north. Accordingly, it is preferable to correct the electronic timepiece W so as to eliminate the deviation as much as the deviation angle from the azimuth of the magnetic north.

In the compass mode, if the crown D is operated and pulled out one step, the deviation angle can be set. Specifically, if the crown D is operated and pulled out one step, the small second hand 41 indicates the positive sign 43*p* if the current deviation angle deviates to the east, and if the current deviation angle deviates to the west, the small second hand 41 indicates the negative sign 43*m*. Furthermore, a numerical value display long hand 33 indicates a one hundred digit value of the current deviation angle, and the center indicating hand 13 is used as a ten digit value and a one digit value of the current deviation angle. After the crown D is operated and pulled out one step, if the rotation operation of the crown D is accepted, the small second hand 41, the numerical value display long hand 33, and the center indicating hand 13 are rotated in response to the rotation operation of the crown D. If the pushing operation of the crown D is accepted, the electronic timepiece W stores the setting of the deviation angle according to each current orientation of the small second hand 41, the center indicating hand 13, and the small second hand 41.

A.1.4. Overview of Barometric Pressure Display Mode

In the barometric pressure display mode, the electronic timepiece W can show the barometric pressure around the electronic timepiece W and whether a variation per unit time in the barometric pressure is positive or negative (hereinafter, referred to as a "barometric pressure tendency"). In a case where the operation button A is pressed several times by the user and the mode indicating hand 21 indicates the character string 23*d*, the electronic timepiece W sets the operation mode to the barometric pressure display mode.

In a case where the operation mode is set to the barometric pressure display mode, the display unit 10 causes the 2 o'clock side information display unit 30, the center indicating hand 13, and the scale 14*c* to display the barometric pressure measured by the barometric pressure sensor 4.

The 2 o'clock side information display unit 30 is provided with a scale 31*a* (example of a "sixth scale"). Furthermore, the 2 o'clock side information display unit 30 has a numerical value display short hand 32 (example of a "third indicating hand") and a numerical value display long hand 33 (example of the "third indicating hand"). The scale 31*a* shows 0 to 9 as the plurality of numerical values which can be indicated by the numerical value display short hand 32 and the numerical value display long hand 33. In the barometric pressure display mode, each number of the scale

31*a* is used as a thousand digit value of "hpa" for the numerical value display short hand 32, and is used as a hundred digit value of "hpa" for the numerical value display long hand 33. Furthermore, each numerical value of the scale 14*c* is used as a ten digit value and a one digit value of "hpa" for the center indicating hand 13.

In a case where the operation mode is set to the barometric pressure display mode, the display unit 10 causes the 10 o'clock side information display unit 40 to display the barometric pressure tendency based on the barometric pressure measured by the barometric pressure sensor 4. Specifically, in a case where the barometric pressure tendency is positive, the small second hand 41 indicates the positive sign 43*p*. In a case where the barometric pressure tendency is negative, the small second hand 41 indicates the negative sign 43*m*.

In the barometric pressure display mode, the current barometric pressure can be recorded as a log, the recorded log can be displayed, and the recorded log can be deleted. The specific processing is the same as that in the elevation degree display mode, and thus, description thereof will be omitted.

The date display unit 50 has a date indicator 51 which displays a calendar date.

A.1.5. Operation State of Electronic Timepiece W and Overview of Battery Level of Electronic Timepiece W The scale 26 is provided with a symbol for showing an operation state of the electronic timepiece W, a symbol for showing a battery level of the electronic timepiece W, and a scale line 28. The operation state of the electronic timepiece W includes a basic operation state and an in-flight operation state. The basic operation state means a state where the electronic timepiece W can not only display the current date and time but also receive radio waves from outside. The in-flight operation state is used in a case where the user travels inside an aircraft, and means a state where receiving the radio waves is restricted. The scale 26 is provided with a character 27*a* "M" showing the basic operation state, an icon 27*b* imitating the aircraft showing the in-flight operation state, a character 27*c* "F" showing that the battery level of the electronic timepiece W is in a fully charged state, and a character 27*d* "E" showing that the battery level of the electronic timepiece W is in a completely discharged state.

The 6 o'clock side information display unit 20 displays that the operation state of the electronic timepiece W is the basic operation state by causing the indicator indicating hand 25 to indicate the character 27*a*. The 6 o'clock side information display unit 20 displays that the operation state of the electronic timepiece W is the in-flight operation state by causing the indicator indicating hand 25 to indicate the icon 27*b*. The 6 o'clock side information display unit 20 displays that the battery level of the electronic timepiece W is in the fully charged state by causing the indicator indicating hand 25 to indicate the character 27*c*. The 6 o'clock side information display unit 20 displays that the battery level of the electronic timepiece W is in the completely discharged state by causing the indicator indicating hand 25 to indicate the character 27*d*.

A.1.6. Color of Symbol of Electronic Timepiece W

A color of a symbol located in the electronic timepiece W is a white or orange color, and a background color of the symbol (hereinafter, referred to as a "symbol background color") located in the display unit 10 is a black color. The symbol includes the number, the character, the character string, the square, and the scale line. The background color means a region other than the above-described symbol, and in particular, means a color of the dial 10*a*, the dial ring 14, and the bezel 15 which are included in the display unit 10. In FIG. 1, the white symbol is illustrated using a black pattern, and the orange symbol is illustrated using a black-outlined white pattern. A color of the number showing at least a portion of the measurement result (hereinafter, referred to as a "measurement result number color") measured by the sensor belonging to the electronic timepiece W such as the GPS receiver 2, the triaxial magnetic sensor 3 and the barometric pressure sensor 4 is a white color. The measurement result includes the value itself measured by the sensor, and also includes a value obtained by applying some processing to the measured value. The color of the symbol relating to the time (hereinafter, referred to as a "time symbol color") is an orange color.

Specifically, the numbers showing at least a portion of the measurement result are the number of the scale 14*c*, the number inside the scale 31*a*, the number inside the scale 42*p*, the number inside the scale 42*m*, and the number inside the scale 42*z*. The number of the scale 14*c* shows a portion of the barometric pressure which is the measurement result measured by the barometric pressure sensor 4 by causing the center indicating hand 13 to indicate the number as described above. Similarly, the number inside the scale 31*a* shows a portion of the barometric pressure which is the measurement result measured by the barometric pressure sensor 4 by causing the numerical value display short hand 32 or the numerical value display long hand 33 to indicate the number. The number inside the scale 42*p*, the number inside the scale 42*m*, and the number inside the scale 42*z* show the elevation degree which is the measurement result measured by the barometric pressure sensor 4 by causing the small second hand 41 to indicate the numbers as described above.

Specifically, the symbols relating to the time are the square 14*b*, the character string inside the scale 15*a*, the number, the "•", the number of the scale 44, the character string inside the scale 45, and the symbol.

The color of the symbol which does not show at least a portion of the measurement result and which does not relate to the time can be either the white color or the orange color. Specifically, the character string 23*a*, the character string 23*b*, the character string 23*c*, the character string 23*d*, the scale line 24, the character 27*a*, the icon 27*b*, the character 27*c*, the character 27*d*, the scale line 28, the character of the operation button A, the character of the operation button B, and the character of the operation button C are the symbols which do not show at least the portion of the measurement result and which do not relate to the time. In the present embodiment, the color of the character string 23*a*, the color of the character string 23*b*, the color of the character string 23*c*, the color of the character string 23*d*, and the color of the scale line 24 are white. The color of the character 27*a*, the color of the icon 27*b*, the color of the character 27*c*, the color of the character 27*d*, the color of the scale line 28, the color of the character of the operation button A, the color of the character of the operation button B, and the color of the character of the operation button C are the orange colors.

Even in a case of the symbol showing at least the portion of the measurement result, the color of the symbol which is not the number can be either the white color or the orange color. Even in a case of the symbol showing at least the portion of the measurement result, the symbols which are not the numbers are the positive sign 43*p* and the negative sign 43*m*. The color of the positive sign 43*p* and the color of the negative sign 43*m* is the orange color.

A.1.7. Color of Indicating Hand of Electronic Timepiece W

A color of a tip portion (example of a "portion of the indicating hand") of the indicating hand belonging to the electronic timepiece W is the white, orange, or black color. In FIG. 1, a white tip portion is illustrated using a black pattern, and an orange tip portion is illustrated by means of shading. A color of a tip portion of the indicating hand relating to the measurement result measured by the sensor (hereinafter, referred to as a "measurement result indicating hand color") is the white color. A color of a tip portion of the indicating hand relating to the time (hereinafter, referred to as a "time indicating hand color") is the orange color.

Specifically, the indicating hands relating to the measurement result are the center indicating hand 13, the numerical value display short hand 32, and the numerical value display long hand 33. The center indicating hand 13, the numerical value display short hand 32, and the numerical value display long hand 33 relate to the barometric pressure measured by the barometric pressure sensor 4 as described above. Specifically, the indicating hands relating to the time are the hour hand 11 and the minute hand 12.

The color of the tip portion of the measurement hand relating to the measurement result and the time can be either the white color or the orange color. The indicating hand relating to the measurement result and the time is the small second hand 41.

The color of the tip portion of the indicating hand which does not relate to not only the measurement result but also the time can be either the white, orange, or black color. The indication hands which do not relate to not only the measurement result but also the time are the mode indicating hand 21 and the indicator indicating hand 25. The color of the tip portion of the mode indicating hand 21 is painted in black and white colors. The color of the tip portion of the indicator indicating hand 25 is the orange color.

As a location relating to the time, a frame of the date display unit 50 is also the orange color. In FIG. 1, the shading shows that the frame of the date display unit 50 is the orange color.

Figure 7:
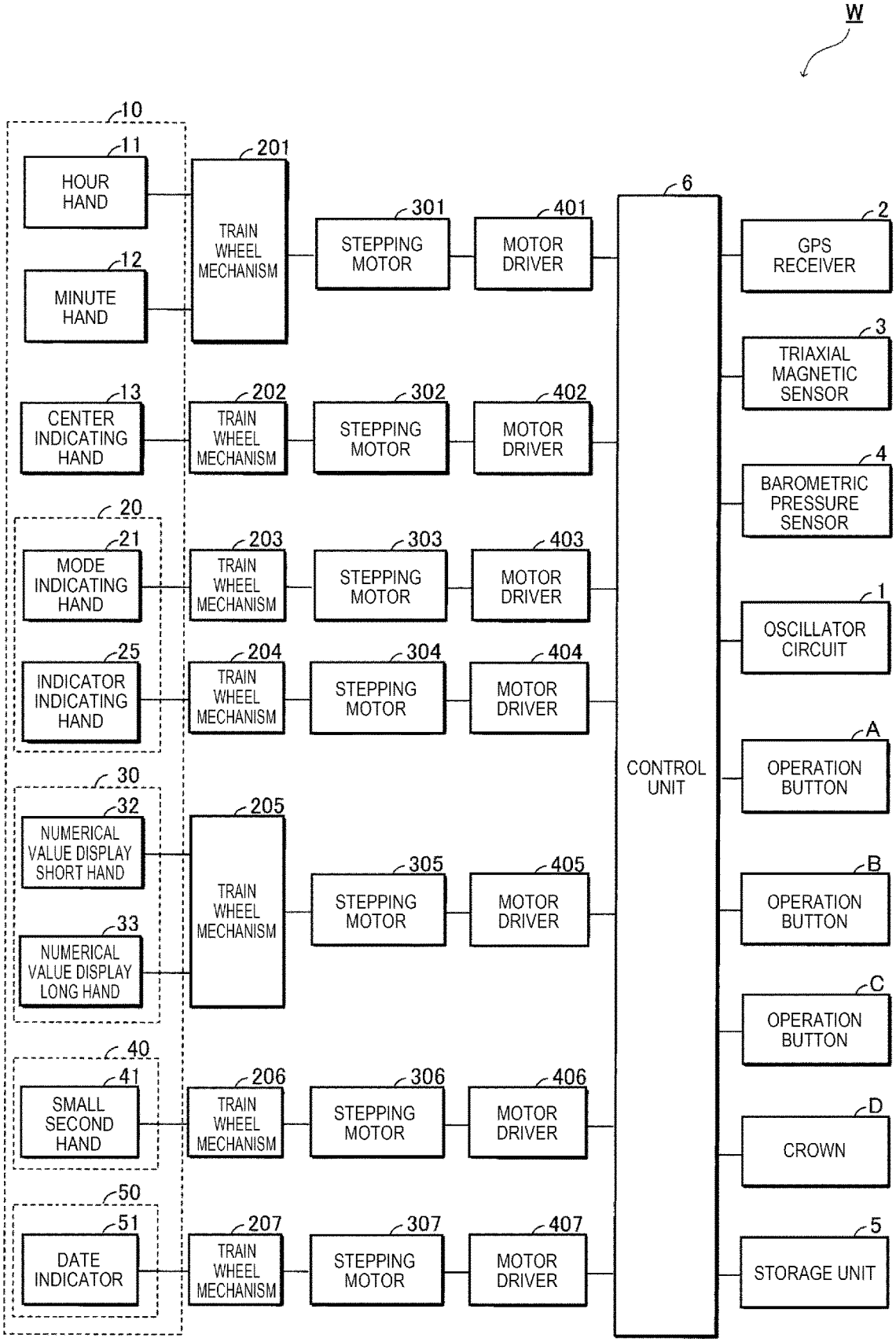
FIG. 7 is a configuration diagram of the electronic timepiece.

FIG. 7 illustrates a configuration diagram of the electronic timepiece W. In FIG. 7, the same reference numerals are given to configurations which are the same as those illustrated in FIGS. 1 to 6.

As a configuration of the hour hand 11, the minute hand 12, the center indicating hand 13, the electronic timepiece W includes the hour hand 11, the minute hand 12, the center indicating hand 13, a train wheel mechanism 201, a train wheel mechanism 202, a stepping motor 301, a stepping motor 302, a motor driver 401, and a motor driver 402. The motor driver 401 drives the stepping motor 301 in order to drive the hour hand 11 and the minute hand 12 via the train wheel mechanism 201. The motor driver 402 drives the stepping motor 302 in order to drive the center indicating hand 13 via the train wheel mechanism 202.

As a configuration relating to the 6 o'clock side information display unit 20, the electronic timepiece W includes the mode indicating hand 21, the indicator indicating hand 25, a train wheel mechanism 203, a train wheel mechanism 204, a stepping motor 303, a stepping motor 304, a motor driver 403, and a motor driver 404. The motor driver 403 drives the stepping motor 303 in order to drive the mode indicating hand 21 via the train wheel mechanism 203. The motor driver 404 drives the stepping motor 304 in order to drive the indicator indicating hand 25 via the train wheel mechanism 204.

As a configuration relating to the 2 o'clock side information display unit 30, the electronic timepiece W includes the numerical value display short hand 32, the numerical value display long hand 33, a train wheel mechanism 205, a stepping motor 305, and a motor driver 405. The motor driver 405 drives the stepping motor 305 in order to drive the numerical value display short hand 32 and the numerical value display long hand 33 via the train wheel mechanism 205.

As a configuration relating to the 10 o'clock side information display unit 40, the electronic timepiece W includes the small secondhand 41, a train wheel mechanism 206, a stepping motor 306, and a motor driver 406. The motor driver 406 drives the stepping motor 306 in order to drive the small second hand 41 via the train wheel mechanism 205.

As a configuration relating to the date display unit 50, the electronic timepiece W includes the date indicator 51, a train wheel mechanism 207, a stepping motor 307, and a motor driver 407. The motor driver 407 drives the stepping motor 307 in order to drive the date indicator 51 via the train wheel mechanism 207.

The electronic timepiece W further includes the oscillator circuit 1, the GPS receiver 2, the triaxial magnetic sensor 3, the barometric pressure sensor 4, the storage unit 5, the control unit 6, the operation button A, the operation button B, the operation button C, and the crown D.

The oscillator circuit 1 generates a clock signal used in order to measure the time. A frequency of the clock signal is 32.768 kHz, for example. The frequency of the clock signal is divided, and the clock signal whose frequency is 1 Hz is input to the control unit 6. The GPS receiver 2 receives a satellite signal from a GPS satellite which is one of positioning information satellites. The triaxial magnetic sensor 3 measures the magnetic north. The barometric pressure sensor 4 measures the barometric pressure around the electronic timepiece W.

The storage unit 5 is a readable and writable nonvolatile recording medium. The storage unit 5 is a flash memory, for example. The storage unit 5 is not limited to the flash memory, and can be appropriately changed. For example, the storage unit 5 stores a program to be executed by the control unit 6.

The control unit 6 is a computer such as a central processing unit (CPU), for example. The control unit 6 controls the whole electronic timepiece W. A configuration of the control unit 6 will be described with reference to FIG. 8.

A.2. Configuration of Control Unit 6 According to Embodiment

Figure 8:
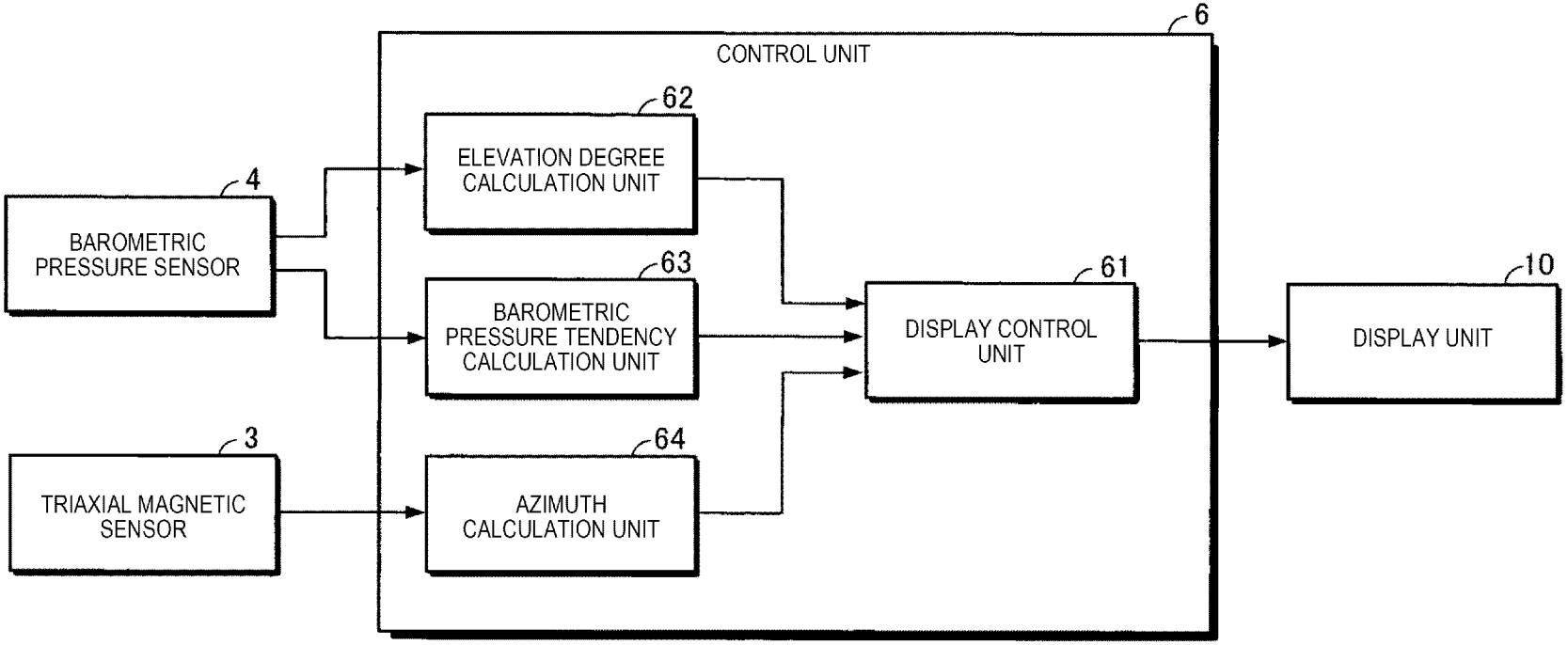
FIG. 8 is a configuration diagram of a control unit.

FIG. 8 illustrates a configuration diagram of the control unit 6. The control unit 6 reads and executes the program stored in the storage unit 5, thereby realizing a display control unit 61, an elevation degree calculation unit 62, a barometric pressure tendency calculation unit 63, and an azimuth calculation unit 64. Hereinafter, the configuration of the control unit 6 will be described for each of an elevation degree display mode, a compass mode, and a barometric pressure display mode.

A.2.1. Configuration of Control Unit 6 in Elevation Degree Display Mode

In the elevation degree display mode, the elevation degree calculation unit 62 acquires the barometric pressure measured by the barometric pressure sensor 4 every second. The elevation degree calculation unit 62 calculates an altitude from the acquired barometric pressure in accordance with Equation (1).

$$ALT=153.8\times(t0+273.2)\times(1-(\text{Acquired Barometric Pressure}/P0)\hat{}0.1902)+(\text{Manual Offset Value}) \quad (1)$$

t0 is reference temperature, and is 15 degrees. P0 is reference barometric pressure, and is 1013.25 hPa. ALT represents the altitude. A unit of the calculated altitude is m (meter). The manual offset value is a value which can be set by a user. The reason for providing the manual offset value is that accuracy of the calculated altitude may become poor depending on the season or the climate if only the first term on the right side of Equation (1) is provided. Therefore, before a coordinate of a destination Dst is set, at a position where the actual altitude is known, the electronic timepiece W calculates the altitude by setting the manual offset value of Equation (1) to 0. Thereafter, the user sets a value obtained by subtracting the calculated altitude from the actual altitude, as the manual offset value. In this manner, the electronic timepiece W can obtain the more accurate altitude compared to a case where the manual offset value is 0.

The elevation degree calculation unit 62 stores the calculated altitude in the storage unit 5. Furthermore, the elevation degree calculation unit 62 calculates a value obtained by subtracting the altitude stored 1 second earlier in the storage unit 5 from the calculated altitude, as the elevation degree. A unit of the elevation degree is m/sec. The elevation degree calculation unit 62 outputs the calculated elevation degree to the display control unit 61. The display control unit 61 controls the small second hand 41 so as to display the acquired elevation degree.

A.2.2. Configuration of Control Unit 6 in Compass Mode

In the compass mode, the azimuth calculation unit 64 acquires the azimuth of the magnetic north measured by the triaxial magnetic sensor 3. The azimuth calculation unit 64 calculates the azimuth of the true north, based on the acquired magnetic north. The azimuth calculation unit 64 outputs the calculated azimuth of the true north to the display control unit 61. The display control unit 61 controls the center indicating hand 13 so that the center indicating hand 13 faces the acquired azimuth of the true north.

A.2.3. Configuration of Control Unit 6 in Barometric Pressure Display Mode

In the barometric pressure display mode, the barometric pressure tendency calculation unit 63 acquires the barometric pressure measured by the barometric pressure sensor 4 every second. The barometric pressure tendency calculation unit 63 stores the acquired barometric pressure in the storage unit 5. Furthermore, the barometric pressure tendency calculation unit 63 outputs the acquired barometric pressure to the display control unit 61. Furthermore, the barometric pressure tendency calculation unit 63 calculates a value obtained by subtracting the barometric pressure stored one second earlier in the storage unit 5 from the acquired barometric pressure. The barometric pressure tendency calculation unit 63 calculates that the barometric pressure tendency is positive if the calculated value is positive. The barometric pressure tendency calculation unit 63 calculates that the barometric pressure tendency is negative if the calculated value is negative. The barometric pressure tendency calculation unit 63 outputs the calculated barometric pressure tendency to the display control unit 61.

The display control unit 61 controls the numerical value display short hand 32, the numerical value display long hand 33, and the center indicating hand 13 so as to indicate the acquired barometric pressure. Furthermore, the display control unit 61 controls the small second hand 41 so as to indicate the calculated barometric pressure tendency.

A.3. Flowchart of Each Operation Mode

Each of the elevation degree display mode and the barometric pressure display mode will be described with reference to a specific flowchart.

A.3.1. Flowchart of Elevation Degree Display Mode

Figure 9:
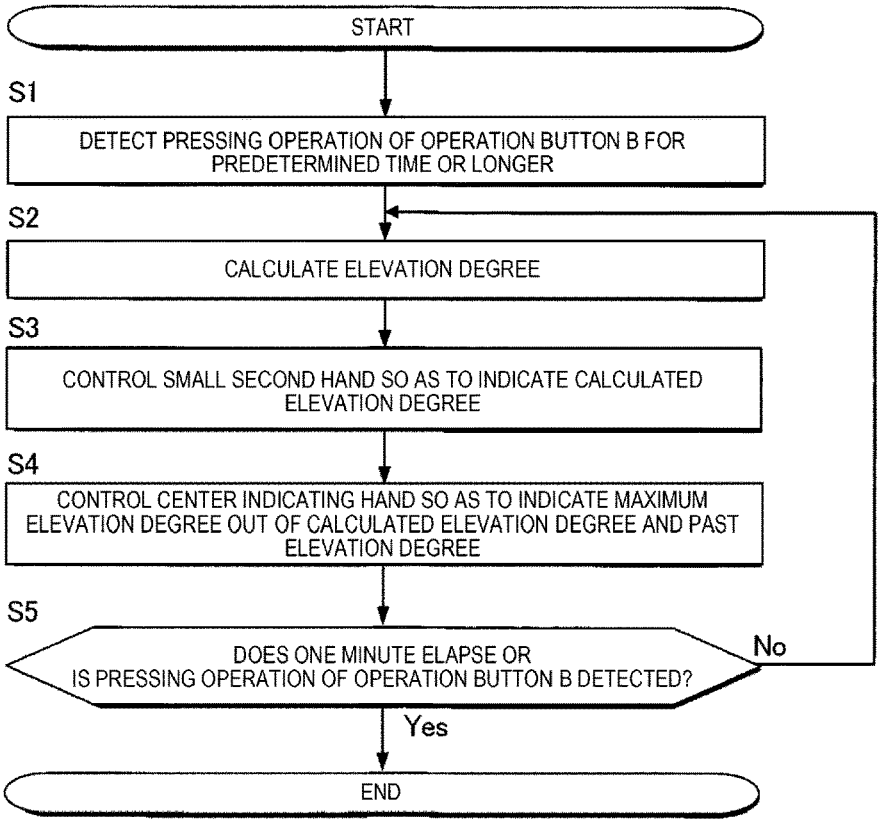
FIG. 9 is a view illustrating a flowchart of an elevation degree display mode.

FIG. 9 illustrates a flowchart of the elevation degree display mode. If the operation button A is pressed several times by a user and the mode indicating hand 21 indicates the character string 23*b*, the electronic timepiece W sets the operation mode to the elevation degree display mode. In the elevation degree display mode, the control unit 6 controls the hour hand 11 and the minute hand 12 so as to display the current time, controls the center indicating hand 13 to stop at a 12 o'clock position, and controls the numerical value display short hand 32 and the numerical value display longhand 33 so as to indicate "0".

In a case where the operation mode is set to the elevation degree display mode, the control unit 6 detects the pressing operation of the operation button B for a predetermined time (for example, 3 seconds) or longer (Step S1). The predetermined time is not limited to 3 seconds, and can be appropriately changed. If the pressing operation for the predetermined time or longer is detected, the elevation degree calculation unit 62 starts to calculate the elevation degree. Next, the elevation degree calculation unit 62 acquires the barometric pressure measured by the barometric pressure sensor 4, and calculates the elevation degree in accordance with Equation (1) (Step S2). Thereafter, the display control unit 61 controls the small second hand 41 so as to indicate the calculated elevation degree (Step S3). The display control unit 61 controls the center indicating hand 13 so as to indicate the maximum elevation degree within the calculated elevation degrees stored in the past in the storage unit 5 (Step S4).

Then, the control unit 6 determines whether one minute elapses after the operation mode is set to the elevation degree display mode, or whether the pressing operation of the operation button B is detected (Step S5). In a case where one minute does not elapse and the pressing operation of the operation button B is not detected (Step S5: No), the elevation degree calculation unit 62 performs a process of Step S2 after 1 second from the previous process. On the other hand, in a case where one minute elapses or the pressing operation of the operation button B is detected (Step S5: Yes), the control unit 6 completes a series of processes.

A.3.2. Flowchart of Barometric Pressure Display Mode

Figure 10:
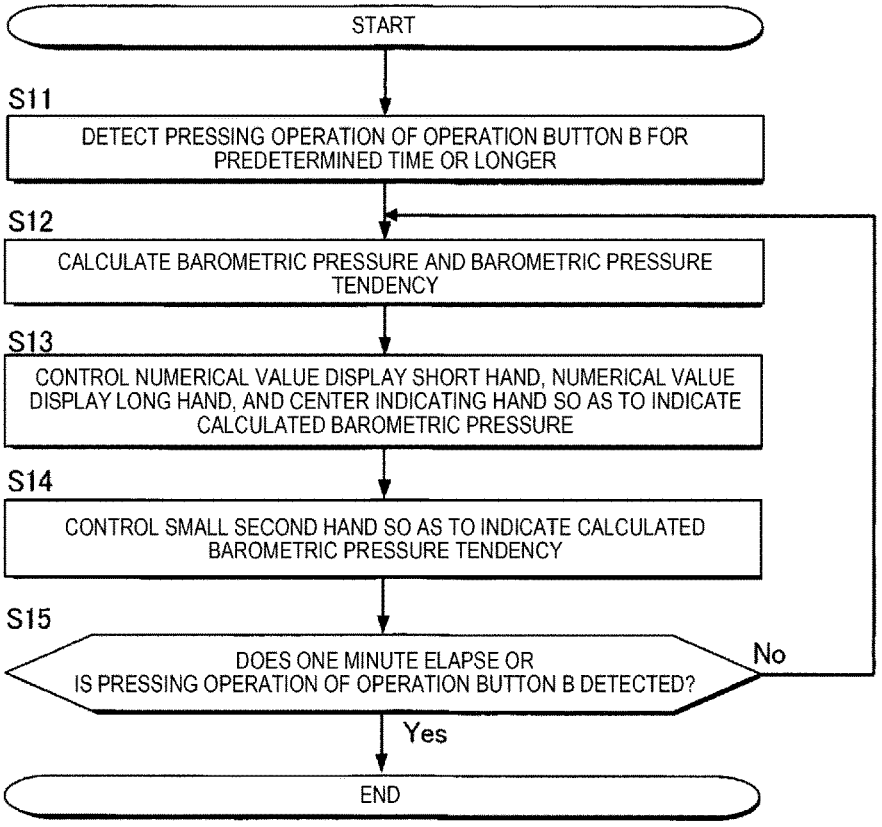
FIG. 10 is a view illustrating a flowchart of a barometric pressure display mode.

FIG. 10 illustrates a flowchart of the barometric pressure display mode. In a case where the operation button A is pressed several times by the user and the mode indicating hand 21 indicates the character string 23*d*, the electronic timepiece W sets the operation mode to the barometric pressure display mode. In a case where the operation mode is set to the barometric pressure display mode, the control unit 6 detects the pressing operation of the operation button B for a predetermined time or longer (Step S11). If the pressing operation for the predetermined time or longer is detected, the barometric pressure tendency calculation unit 63 starts to calculate the barometric pressure and the barometric pressure tendency. Next, the barometric pressure tendency calculation unit 63 calculates the barometric pressure and the barometric pressure tendency (Step S12). Thereafter, the display control unit 61 controls the numerical value display short hand 32, the numerical value display long hand 33, and the center indicating hand 13 so as to indicate the calculated barometric pressure (Step S13). The display control unit 61 controls the small second hand 41 so as to indicate the calculated barometric pressure tendency (Step S14).

Then, the control unit 6 determines whether one minute elapses after the operation mode is set to the barometric pressure display mode, or whether the pressing operation of the operation button B is detected (Step S15). In a case where one minute does not elapse and the pressing operation of the operation button B is not detected (Step S15: No), the barometric pressure tendency calculation unit 63 performs a process of Step S12 after one second from the previous process. On the other hand, in a case where one minute elapses or the pressing operation of the operation button B is detected (Step S15: Yes), the control unit 6 completes a series of processes.

A.4. Advantageous Effect of Embodiment

Figure 11:
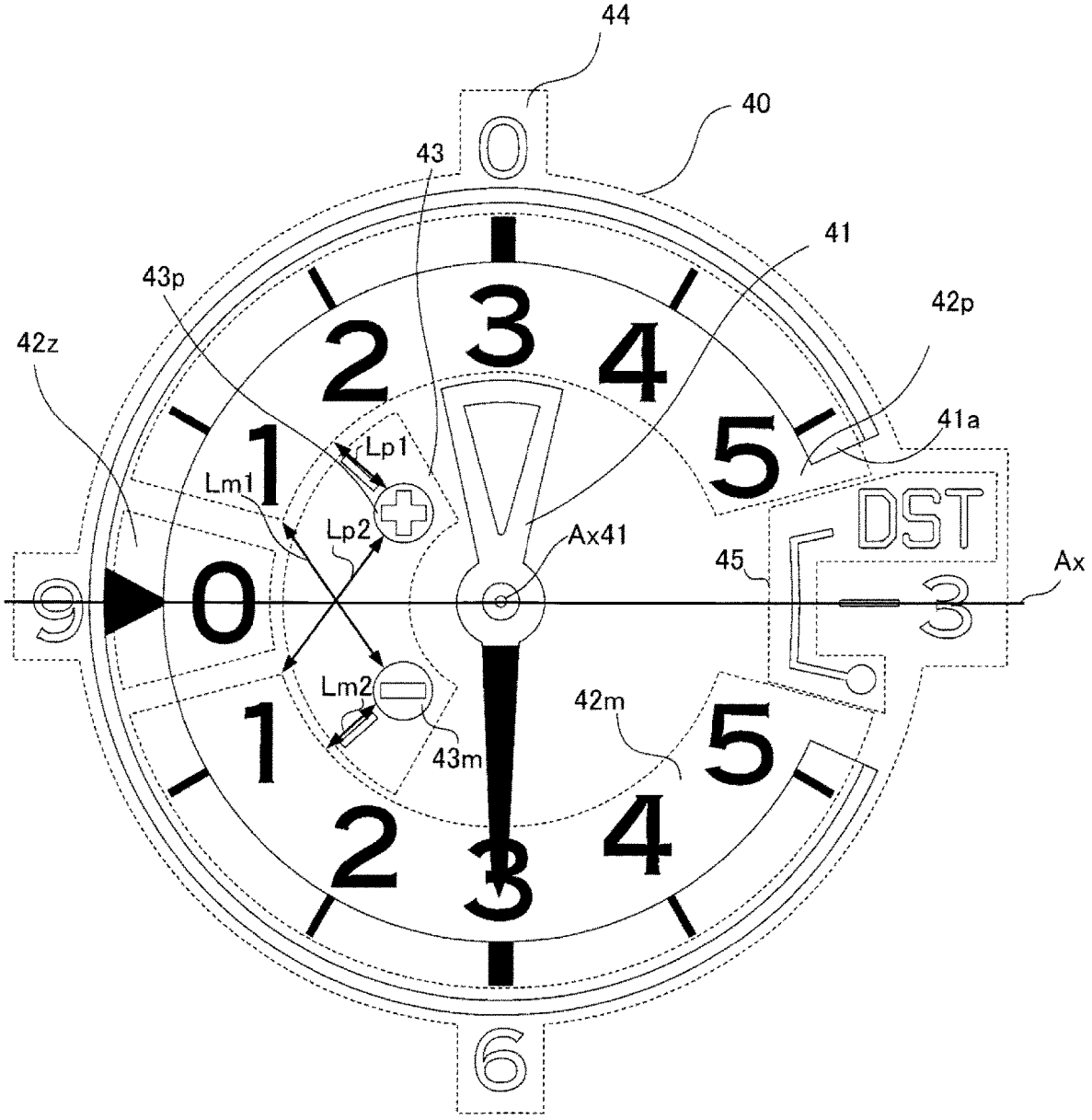
FIG. 11 is a view illustrating a 10 o'clock side information display unit 30.

FIG. 11 shows the 10 o'clock side information display unit 40. As illustrated in FIG. 11, each number of the scale 42*p* and each number of the scale 42*m* show the absolute value of the plurality of numerical values, and are not provided with "+" showing the positive value and "−" showing the negative value. Accordingly, the number of characters located inside the dial 10*a* is reduced, thereby enabling the character inside the dial 10*a* to be easily viewed. However, in a case where there is no scale 43, the user can read that the numerical value indicated by each number of the scale 42*p* is positive, or can read that the numerical value indicated by each number of the scale 42*m* is positive. Therefore, the user is less likely to read whether the numerical value indicated by the small second hand 41 is positive or negative.

According to the present embodiment, as illustrated in FIG. 11, a shortest distance Lp1 from the scale 42*p* to the positive sign 43*p* is shorter than a shortest distance Lm1 from the scale 42*p* to the negative sign 43*m*. That is, the positive sign 43*p* is located closer to each number of the scale 42*p* than the negative sign 43*m*. Therefore, the electronic timepiece W can show that the numerical value indicated by each number of the scale 42*p* is positive even though each number of the scale 42*p* is not provided with "+". As a result of showing that the numerical value indicated by each number of the scale 42*p* is positive, the user can easily read that the numerical value indicated by each number of the scale 42*p* is positive.

Similarly, a shortest distance Lm2 from the scale 42*m* to the negative sign 43*m* is shorter than a shortest distance Lp2 from the scale 42*m* to the positive sign 43*p*. That is, the negative sign 43*m* is located closer to each number of the scale 42*m* than the positive sign 43*p*. Therefore, the electronic timepiece W can show that the numerical value indicated by each number of the scale 42*m* is negative even though each number of the scale 42*m* is not provided with "−". As a result of showing that the numerical value indicated by each number of the scale 42*m* is negative, the user can easily read that the numerical value indicated by each number of the scale 42*m* is negative.

According to the above-described configuration, in the present embodiment, while the number of characters located inside the dial 10*a* is reduced, each number of the scale 42*p* and each number of the scale 42*m* can be easily read. Therefore, it is possible to improve legibility of each number of 42*p* and each number of the scale 42*m*.

Furthermore, the positive sign 43*p* and the negative sign 43*m* are respectively disposed one by one in the display unit 10. Therefore, the user can easily read whether the numerical value shown by each number of the scale 42*p* and each number of the scale 42*m* is positive or negative.

The small second hand 41 indicates the numerical value of the scale 42*p* or the numerical value of the scale 42*m* in accordance with the elevation degree. According to the present embodiment, the user can easily read the numerical value indicated by each number of the scale 42*p* and each number of the scale 42*m*. Accordingly, the user can easily read the elevation degree shown by the numerical value. For example, in a case where the user enjoys aerosports such as paragliding or hang gliding, it is important for the user to obtain the elevation degree. The reason that obtaining the elevation degree is important is that the user can use the identified elevation degree in order to find rising air currents and avoid falling air currents. Even if the user does not enjoy the aerosports, the user may be interested in knowing the elevation degree in a case where the user rides on a high-speed elevator. In this case, the electronic timepiece W can provide the user with the elevation degree.

The small secondhand 41 indicates the positive sign 43*p* if the barometric pressure tendency is positive, and indicates the negative sign 43*m* if the barometric pressure tendency is negative. The user can easily read the barometric pressure tendency indicated by the positive sign 43*p* and the negative sign 43*m*.

As illustrated in FIG. 11, in a plan view in an axial direction of an indicating hand axle Ax41 of the small second hand 41, that is, in a +z direction, each number of the scale 42*p* and each number of the scale 42*m* are arranged line-symmetrically with respect to a virtual straight line Ax passing through the indicating hand axle Ax41 and the scale 42*z*. In general, in a case of a variometer which is one of aircraft instruments, the number "0" showing 0 m/sec is located in a 9 o'clock direction, and the numbers "1", "2", and "3" showing an ascending state, and the numbers "−1", "−2", and "−3" showing a descending state are arranged line-symmetrically with respect to the number "0" and the virtual straight line Ax passing through the indicating hand. In this way, an arrangement aspect of each number of the scale 42*p* and each number of the scale 42*m* according to the present embodiment is the same as an arrangement aspect of the numbers inside the general variometer. Accordingly, the user reads the 10 o'clock side information display unit 40, thereby enabling the user to identify the elevation degree in the same manner as the general variometer.

As illustrated in FIG. 1, in a plan view in the axial direction of the indicating hand axle Ax13 of the center indicating hand 13, that is, in the +z direction, the scale 14*c* is located between the indicating hand axle Ax13 and the scale 15*a*. In other words, the scale 15*a* is located outside the scale 14*c*. The scale 15*a* shows a plurality of time zones, and the time zone is set in a case where the user travels across the time zone. In general, the user does not frequently travel across the time zone. Accordingly, it can be considered that the scale 15*a* is less frequently used than the scale 14*c*. Incidentally, if the scale 14*c* is located inward, a distance from the center indicating hand 13 becomes closer compared to a case where the scale 14*c* is located outward. Therefore, the user is likely to read the numerical value indicated by the center indicating hand 13 out of the plurality of numerical values of the scale 14*c*.

Therefore, the scale 15*a* which is less frequently used is located outward, and the scale 14*c* which is more frequently used is located inward. In this manner, the user can easily read the numerical value of the scale 14*c* which is more frequently used.

Furthermore, as illustrated in FIG. 1, according to a method of showing the time zones by using the character string "UTC" and the number "1" inside the scale 15*a*, compared to a method of arranging city names respectively belonging to the plurality of time zones, the time zones can be shown using fewer character numbers. Accordingly, the character numbers inside the bezel 15 are reduced, and the user can easily read the time zones. Furthermore, the method of showing the time zones by using the character string "UTC" and the number "1" is generally used for the aircraft in many cases. Therefore, the scale 15*a* can stimulate aesthetics and curiosity of the user who is attracted by the aircraft.

As described referring to FIG. 1, the measurement result number color is a white color. On the other hand, the time symbol color is an orange color. The symbol background color is a black color. In this way, a lightness difference between the measurement result number color and the symbol background color is greater than a lightness difference between the time symbol color and the symbol background color. In general, as the lightness difference increases between the foreground color and the background color, the foreground color is more easily viewed. If the measurement result and the time are compared with each other, the measurement result is more important information. Therefore, the electronic timepiece W enables the user to more easily view the number showing at least a portion of the measurement result which is more important than the time. The lightness means an index representing brightness of the color, and can be represented using the numerical values of 0 to 10 if the white color having reflectance of 100% is set as the lightness 10. The lightness can be measured using a colorimeter or a spectrophotometer.

A color difference between the measurement result number color and the symbol background color is greater than a color difference between the time symbol color and the symbol background color. Here, a color difference between a first color and a second color is obtained using Equation (2) below, for example.

$$\text{Color Difference}=((R2-R1)\hat{}2+(G2-G1)\hat{}2+(B2-B1)\hat{}2)\hat{}0.5 \quad (2)$$

R1, G1, and B1 are respectively a red element of the first color, a green element of the first color, and a blue element of the first color. Similarly, R2, G2, and B2 are respectively the red element of the second color, the green element of the second color, and the blue element of the second color. The color difference can be calculated from values of R1, G1, B1, R2, G2, and B2 measured using the spectrophotometer or a color difference meter.

In general, as the color difference increases between the foreground color and the background color, the foreground color and the background color are easily distinguished from each other, and the foreground color is easily viewed. Therefore, the electronic timepiece W enables the user to easily view the number showing at least a portion of the measurement result which is more important than the time.

As described referring to FIG. 1, the measurement result indicating hand color is the white color. On the other hand, the time indicating hand color is the orange color. In this way, the lightness difference between the measurement result indicating hand color and the symbol background color is greater than the lightness difference between the time indicating hand color and the symbol background color. Therefore, the electronic timepiece W enables the user to more easily view the tip portion of the indicating hand relating to the measurement result which is more important than the time.

The color difference between the measurement result indicating hand color and the symbol background color is greater than the color difference between the time indicating hand color and the symbol background color. Therefore, the electronic timepiece W enables the user to more easily view the tip portion of the indicating hand relating to the measurement result which is more important than the time.

B. Modification Example

The above-described respective embodiments can be modified in various ways. Hereinafter, specific modification examples will be described. Two or more aspects optionally selected from the following examples can be appropriately combined with each other within the scope having no contradiction therebetween. In the modification examples described below, elements having operation effects and functions which are the same as those in the embodiments will be denoted by the reference numerals used in the above description, and detailed description thereof will be appropriately omitted.

B.1. First Modification Example

In the compass mode according to the embodiment, the azimuth of the true north can be shown. On the other hand, in the compass mode according to a first modification example, in addition to showing the azimuth of the true north, an azimuth angle of a way point Wpt (refer to FIG. 15) and a distance from a current position to the way point Wpt can be shown. The way point Wpt is point information on a route in navigation, and for example, the way point Wpt is a position previously registered in the storage unit 5. For example, in a case where the user travels for business, the user operates the electronic timepiece W so that a location of a hotel for the user to stay is registered to the way point Wpt. Then, in a case where the user goes out of the hotel and wants to return to the hotel, the electronic timepiece W can cause the compass mode to show the azimuth angle of the location of the hotel which is the way point Wpt and the distance from the current position to the location of the hotel.

Furthermore, according to the first modification example, it is possible to set a displayable range of the distance from the current position to the way point Wpt. Hereinafter, the displayable range will be referred to as a "range". More specifically, according to the first modification example, the electronic timepiece W can set the range of distances up to the way point Wpt as any one of a first range which is shorter than 10 km from 0 m, a second range which is shorter than 100 km from 0 m, and a third range which is shorter than 1,000 km from 0 m.

Figure 12A:
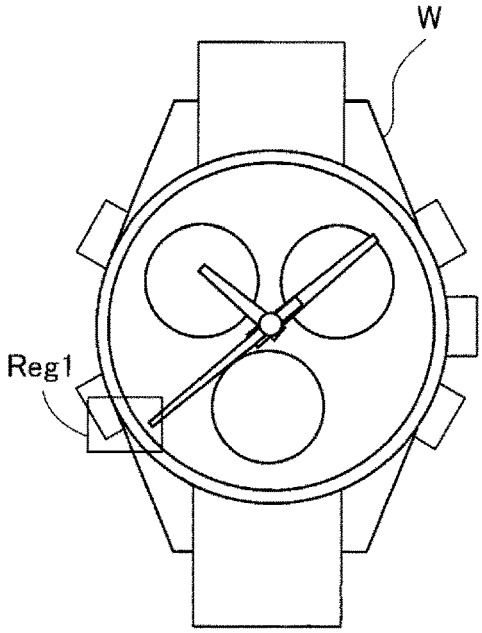
FIGS. 12A and 12B show a plan view of an electronic timepiece according to a first modification example.
Figure 12B:
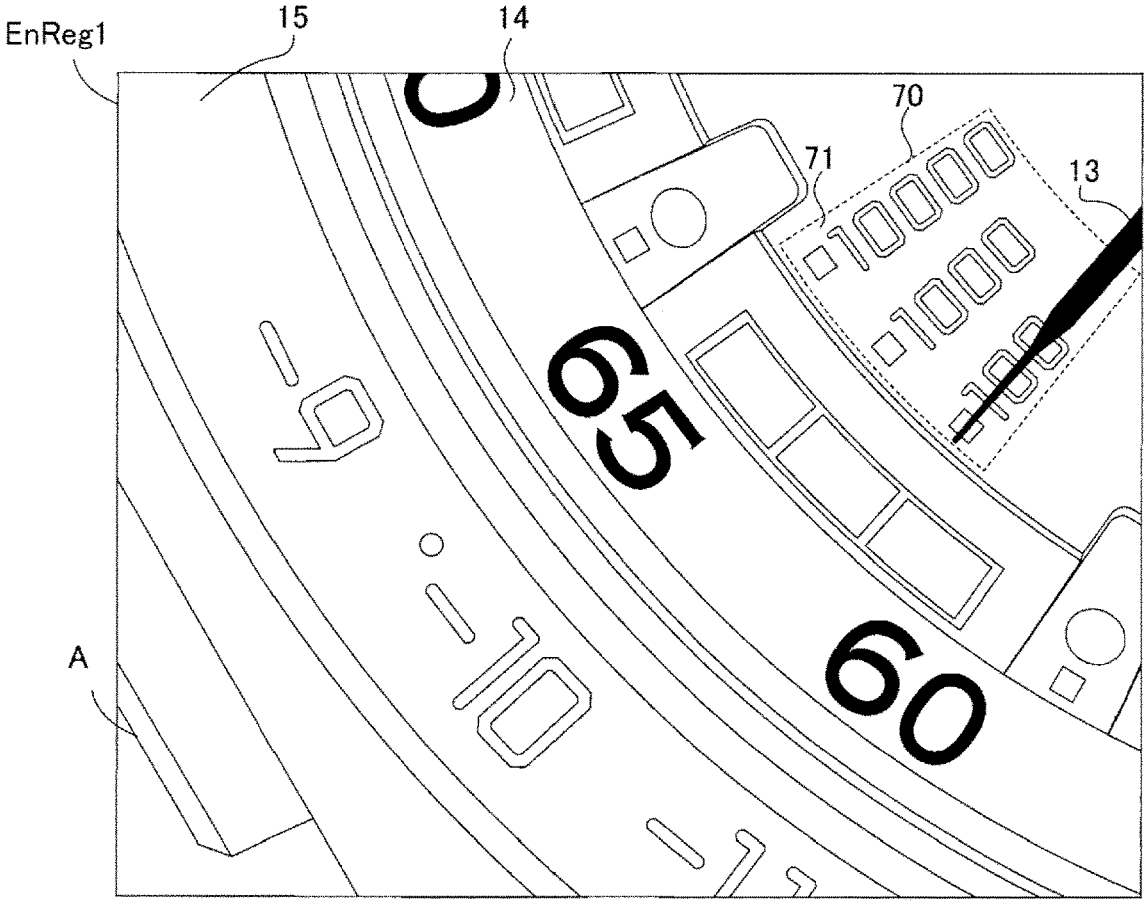

FIGS. 12A and 12B illustrate a plan view of the electronic timepiece W according to the first modification example. Unless otherwise described, in order to omit the description, it is assumed that elements described below relate to the first modification example. FIGS. 12A and 12B illustrate an enlarged region EnReg1 in which a region Reg1 is enlarged.

As illustrated in the enlarged region EnReg1, the display unit 10 has the 7 o'clock side information display unit 70. The 7 o'clock side information display unit 70 includes a portion of the dial 10*a*.

The 7 o'clock side information display unit 70 has a scale 71 (example of a "fifth scale"). The scale 71 shows a plurality of 10 power law exponents which can be indicated by the center indicating hand 13. Specifically, the scale 71 is provided with a number "100", a number "1000", and a number "10000" as the number showing the plurality of 10 power law exponents. Hereinafter, the 10 power law exponents shown in the scale 71 will be referred to as a "range value". In a case where the center indicating hand 13 indicates a first range value "100", the 7 o'clock side information display unit 70 shows that the current range is a first range. In a case where the center indicating hand 13 indicates a second range value "1000", the 7 o'clock side information display unit 70 shows that the current range is a second range. In a case where the center indicating hand 13 indicates a third range value "10000", the 7 o'clock side information display unit 70 shows that the current range is a third range.

Hereinafter, in order to simplify the description, a range subsequent to the first range will be referred to as the second range, a range subsequent to the second range will be referred to as the third range, and a range subsequent to the third range will be referred to as the first range.

The number inside the scale 71 is used in setting the range. The number is not used in showing the measurement result, and does not relate to the time. Therefore, the number inside the scale 71 can be either the white color or the orange color. According to the first modification example, the number inside the scale 71 is the orange color.

In an example illustrated in FIGS. 12A and 12B, the center indicating hand 13 indicates the number "100". Accordingly, it is shown that the current range is the first range. In a case where the current range is the first range, each number of the scale 31*a* is used as a one digit value of "km" for the numerical value display short hand 32, and is used as a hundred digit value of "m" for the numerical value display long hand 33. Similarly, in a case where the current range is the second range, each number of the scale 31*a* is used as a ten digit value of "km" for the numerical value display short hand 32, and is used as a one digit value of "km for the numerical value display long hand 33. Similarly, in a case where the current range is the third range, each number of the scale 31*a* is used as a hundred digit value of "km" for the numerical value display short hand 32, and is used as a ten digit value of "km" for the numerical value display long hand 33.

B.1.1. Overview of Compass Mode

In the compass mode, the electronic timepiece W can show the azimuth of the true north and the azimuth and distance up to the way point Wpt. In a case where the operation mode is set to the compass mode, based on the azimuth of the magnetic north measured by the triaxial magnetic sensor 3, the display unit 10 controls the center indicating hand 13 so that the orientation of the center indicating hand 13 faces the true north.

Furthermore, the display unit 10 shows the azimuth of the way point Wpt by using the orientation of the small second hand 41. Furthermore, the display unit 10 shows the distance of the way point Wpt by causing the numerical value display short hand 32 and the numerical value display long hand 33 to indicate the numerical value.

Figure 13:
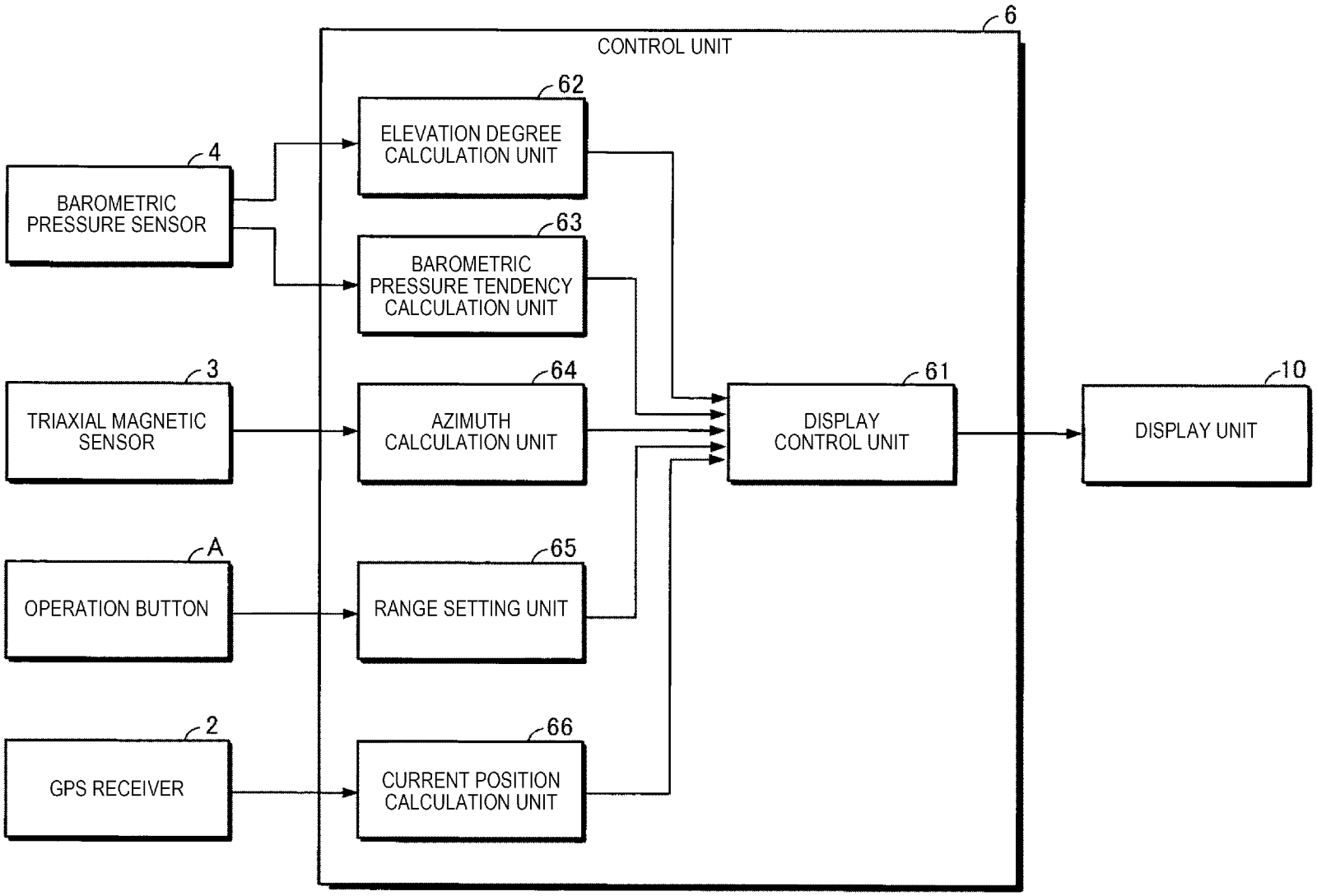
FIG. 13 is a configuration diagram of a control unit according to the first modification example.

B.1.2. Configuration of Control Unit 6 According to First Modification Example FIG. 13 illustrates a configuration diagram of the control unit 6. The control unit 6 reads and executes a program stored in the storage unit 5, thereby realizing the display control unit 61, the elevation degree calculation unit 62, the barometric pressure tendency calculation unit 63, the azimuth calculation unit 64, the range setting unit 65, and the current position calculation unit 66. Hereinafter, a configuration of the control unit 6 will be described with regard to the compass mode.

B.1.2.1. Configuration of Control Unit 6 in Compass Mode

In the compass mode, the range setting unit 65 sets a range. Specifically, the range setting unit 65 acquires the current range from the storage unit 5. In a case where the current range is not set, the range setting unit 65 acquires an initial value of the range stored in the storage unit 5. The range setting unit 65 outputs the acquired range to the display control unit 61. The display control unit 61 controls the center indicating hand 13 so as to show the range value of the acquired range.

Next, the range setting unit 65 sets the range in accordance with the number of times of pressing operation of the operation button A for a predetermined time or longer. For example, the range setting unit 65 sets the range to the range subsequent to the current range in a case where the pressing operation of the operation button A is performed once for the predetermined time or longer. In a case where the range is set, the range setting unit 65 outputs the set range to the display control unit 61. The display control unit 61 controls the center indicating hand 13 so as to show the range value of the range after the range is set.

The current position calculation unit 66 acquires a satellite signal from the GPS receiver 2, and calculates a coordinate of the current position, based on the acquired satellite signal. The current position calculation unit 66 outputs the calculated coordinate of the current position to the display control unit 61.

The display control unit 61 calculates the distance from the current position to the way point Wpt and the azimuth angle of the way point Wpt, based on the coordinate of the position previously registered in the storage unit 5 and the coordinate of the current position calculated by the current position calculation unit 66.

In accordance with the first value obtained by dividing the distance from the current position to the way point Wpt (example of a "numerical value of a display target") by the current range value, the display control unit 61 controls the numerical value display short hand 32 and the numerical value display long hand 33 so as to indicate the numerical value of the scale 31*a*. Under the control of the display control unit 61, the numerical value display short hand 32 and the numerical value display long hand 33 indicate the numerical value of the scale 31*a* in accordance with the first value. Specifically, the display control unit 61 causes the numerical value display short hand 32 to indicate the ten digit value of the first value, and causes the numerical value display long hand 33 to indicate the one digit value of the first value. For example, it is assumed that the calculated distance is 1,200 m and the current range value is "100". In this case, the first value obtained by dividing 1,200 by 100 is 12. Accordingly, the display control unit 61 controls the numerical value display short hand 32 and the numerical value display long hand 33 so that the numerical value display short hand 32 indicates "1" and the numerical value display long hand 33 indicates "2".

The calculated azimuth angle is the azimuth angle of the way point Wpt in a global coordinate system. Therefore, the display control unit 61 converts the azimuth angle into the azimuth angle of the way point Wpt in a local coordinate system of the electronic timepiece W by using the true north calculated by the azimuth calculation unit 64. The display control unit 61 controls the small second hand 41 so that the orientation of the small second hand 41 shows the converted azimuth angle.

B.1.3. Flowchart of Operation Mode

The compass mode will be described using a specific flowchart.

B.1.3.1. Flowchart of Compass Mode

Figure 14:
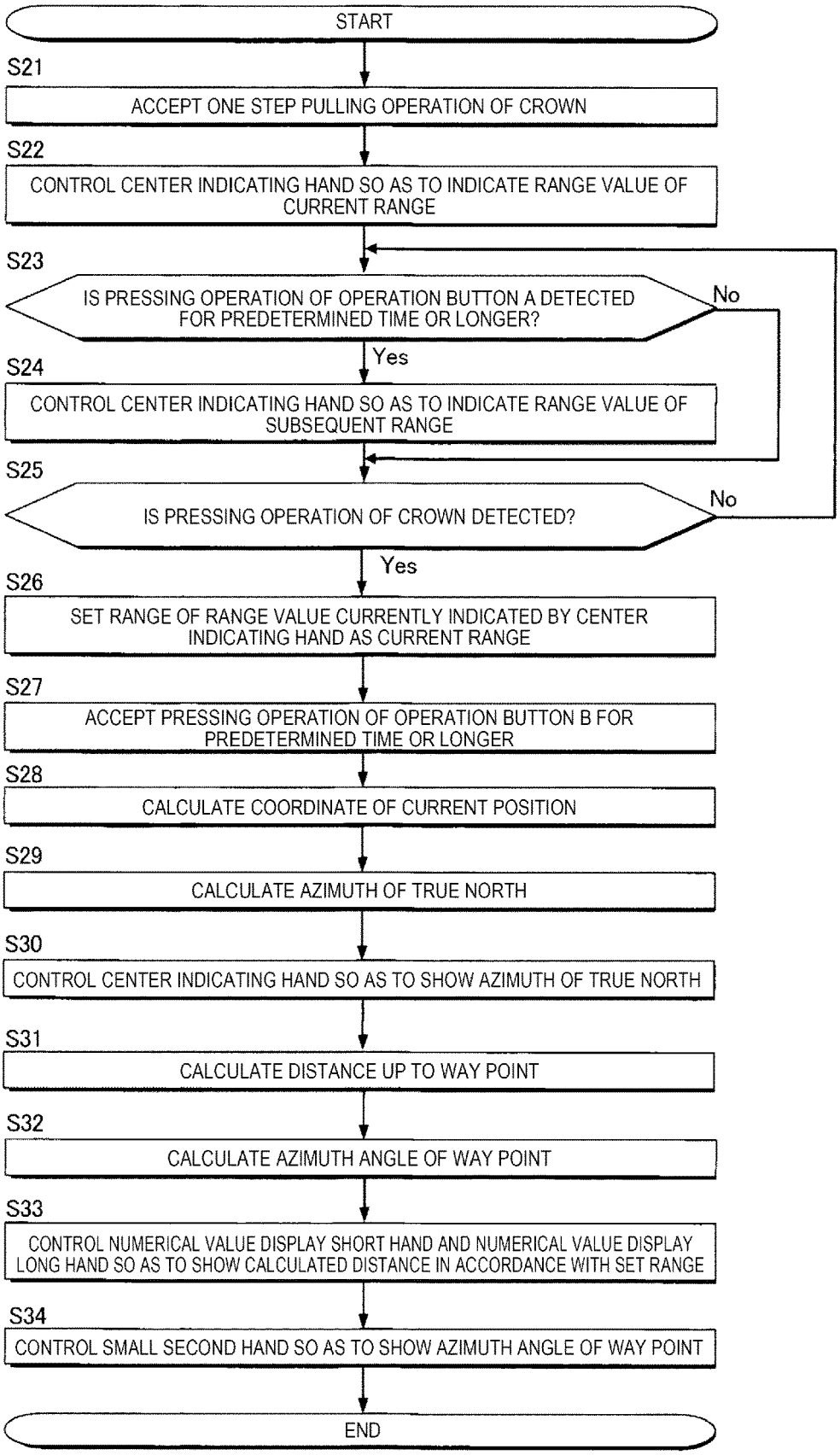
FIG. 14 is a view illustrating a flowchart of a compass mode.

FIG. 14 illustrates a flowchart of the compass mode. In a case where the operation button A is pressed several times by the user and the mode indicating hand 21 indicates the character string 23*c*, the electronic timepiece W sets the operation mode to the compass mode. The control unit 6 accepts a one step pulling operation of the crown D in a case where the operation mode is set to the compass mode (Step S21). If the pulling operation of the crown D is accepted, the display control unit 61 controls the center indicating hand 13 so as to indicate the range value of the current range (Step S22).

The control unit 6 determines whether or not the pressing operation of the operation button A is detected for a predetermined time or longer (Step S23). In a case where the pressing operation of the operation button A is detected for the predetermined time or longer (Step S23: Yes), the display control unit 61 controls the center indicating hand 13 so as to indicate the range value of the subsequent range (Step S24). After the process in Step S24 is performed or in a case where the pressing operation of the operation button A is not detected for the predetermined time or longer (Step S23: No), the control unit 6 determines whether or not the pressing operation of the crown D is detected (Step S25). In a case where the pressing operation of the crown D is not detected (Step S25: No), the control unit 6 returns to the process in Step S23.

On the other hand, in a case where the pressing operation of the crown D is detected (Step S25: Yes), the range setting unit 65 sets the range of the range value currently indicated by the center indicating hand 13 as the current range (Step S26). Next, the control unit 6 accepts the pressing operation of the operation button B for the predetermined time or longer (Step S27). If the pressing operation of the operation button B for the predetermined time or longer is accepted, the current position calculation unit 66 starts to calculate the coordinate of the current position, and the azimuth calculation unit 64 starts to calculate the azimuth of the true north. Then, the current position calculation unit 66 calculates the coordinate of the current position (Step S28). The azimuth calculation unit 64 calculates the azimuth of the true north, based on the direction of the geomagnetism measured by the triaxial magnetic sensor 3 (Step S29). The display control unit 61 controls the center indicating hand 13 so as to indicate the azimuth of the true north (Step S30).

Then, based on the coordinate of the current position and the coordinate of the way point Wpt stored in the storage unit 5, the display control unit 61 calculates the distance from the current position to the way point Wpt (Step S31). Furthermore, the display control unit 61 calculates the azimuth angle of the way point Wpt in the local coordinate system of the electronic timepiece W, based on the coordinate of the current position, the coordinate of the way point Wpt, and the azimuth of the true north (Step S32). The display control unit 61 controls the numerical value display short hand 32 and the numerical value display long hand 33 so as to show the calculated distance in accordance with the set range (step S33). The display control unit 61 controls the small second hand 41 so as to show the azimuth angle of the way point Wpt (Step S34). After the process in Step S34 is completed, the control unit 6 completes a series of processes. Each orientation of the numerical value display short hand 32, the numerical value display long hand 33, the center indicating hand 13, and the small secondhand 41 in the compass mode will be described with reference to FIG. 15.

Figure 15:
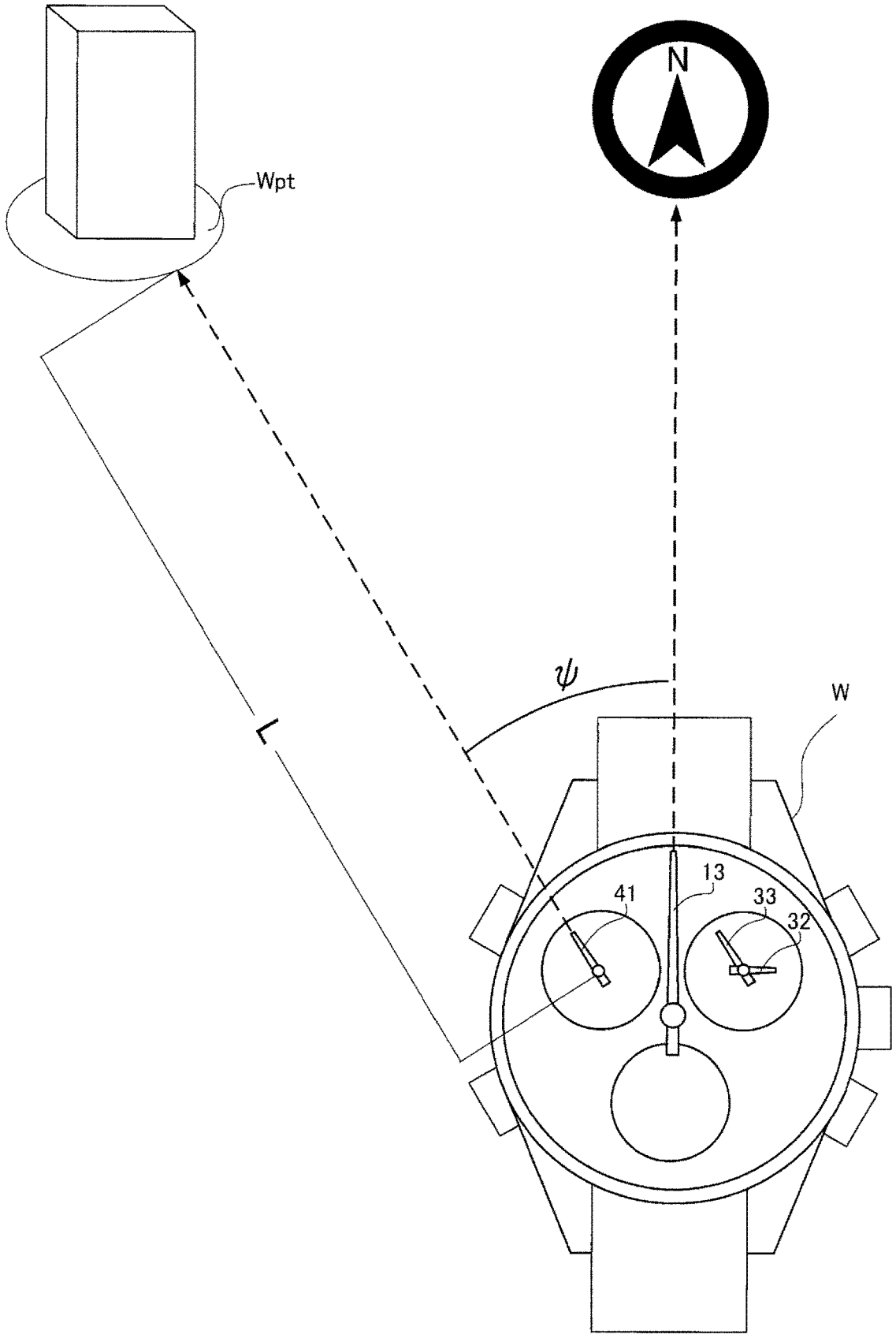
FIG. 15 is a view illustrating an example of an orientation of an indicating hand in the compass mode.

FIG. 15 illustrates an example of the orientation of the indicating hand in the compass mode. The process in Step S29 is performed so that the center indicating hand 13 indicates the azimuth of the true north. The numerical value display short hand 32 and the numerical value display longhand 33 show a calculated distance L by performing the process in Step S32. The process in Step S34 is performed so that the small second hand 41 shows a calculated azimuth angle $\phi$.

B.1.4. Advantageous Effect of First Modification Example

As described above, the numerical value display short hand 32 and the numerical value display long hand 33 indicate the numerical value of the scale 31*a* in accordance with the value obtained by dividing the distance from the current position to the way point Wpt by the current range value. In this manner, the electronic timepiece W properly changes the range. Accordingly, compared to a case where the range is not changed, it is possible to increase the numerical values which can be displayed using the scale 31*a*. For example, it is assumed that the distance from the current position to the way point Wpt is 10 km to shorter than 100 km and the range value is set to "100". In this assumption, the range value is "100" and exceeds the displayable numerical value. Accordingly, the numerical value display short hand 32 and the numerical value display long hand 33 indicate the number "0" of the scale 31*a*, and cannot indicate a correct distance. Therefore, the electronic timepiece W sets the range value to "10000" through the operation of the user. In this manner, the numerical value display short hand 32 and the numerical value display long hand 33 can indicate a proper number of the scale 31*a* in accordance with the distance from the current position to the way point Wpt.

The user reads the numerical value indicated by the numerical value display short hand 32 and the numerical value display long hand 33. In this manner, for example, the user can properly determine whether to walk or ride a taxi to the way point Wpt.

B.2. Other Modification Examples

In the first modification example, as the 10 power law exponents which can be indicated by the center indicating hand 13, the number "100", the number "1000", and the number "10000" are arranged inside the 7 o'clock side information display unit 70. However, the invention is not limited to these numbers. For example, the 10 power law exponents may be the number "1" which is the power of 10 to the power of zero, or the number "0.1" which is the power of 10 to the negative 1st power. Instead of the number "10000", the number indexed like the number "104" or "1.0E4" may be located inside the 7 o'clock side information display unit 70.

In the above-described respective embodiments, the scale 42*p*, the scale 42*m*, and the scale 42*z* are used in order to display the elevation degree, but may be used in order to display other numerical values. For example, the scale 42*p*, the scale 42*m*, and the scale 42*z* may display an altitude, a temperature, or ultraviolet intensity. In a case of displaying the altitude, the 10 o'clock side information display unit 40 may employ the scale 42*p*, the scale 42*m*, and the scale 42*z* as a logarithmic scale. For example, in FIG. 1, the number "1" of the scale 42*p* may show 10 m, the number "2" of the scale 42*p* may show 100 m, the number "3" of the scale 42*p* may show 1,000 m, the number "4" of the scale 42*p* may show 10,000 m, and the number "5" of the scale 42*p* may show 100,000 m. Similarly, the number "1" of the scale 42*m* may show −10 m, and the number "2" of the scale 42*m* may show −100 m. In a case of displaying the temperature or the ultraviolet intensity, the small second hand 41 may indicate the positive sign 43*p* if the tendency of the temperature or the ultraviolet intensity is positive, and may indicate the negative sign 43*m* if the tendency of the temperature or the ultraviolet intensity is negative. The user can easily read the tendency of the temperature or the ultraviolet intensity shown by the positive sign 43*p* and the negative sign 43*m*.

In the above-described respective embodiments, as illustrated in FIGS. 12A and 12B, each number of the scale 42*p* and each number of the scale 42*m* are arranged line-symmetrically with respect to the virtual straight line Ax. However, the invention is not limited thereto. Furthermore, the number of the scales 42*p* is the same as the number of the scales 42*m* so as to be line-symmetrically with respect to the straight line Ax. However, the invention is not limited thereto. For example, in a case where the scale 42*p*, the scale 42*m*, and the scale 42*z* display the altitude or the temperature, with regard to the range for dealing with the numerical value showing the altitude or the temperature, the positive range is wider than the negative range. Therefore, the scale 42*p* showing the numerical value in the positive range may be larger than the scale 42*m* showing the numerical value in the negative range. For example, in the example illustrated in FIGS. 12A and 12B, the scale 42*p* is located from the 10 o'clock position to the 2 o'clock position inside the 10 o'clock side information display unit 40, and the scale 42*m* is located from the 4 o'clock position to 8 o'clock position. However, the scale 42*p* may be located from the 10 o'clock position to the 4 o'clock position inside the 10 o'clock side information display unit 40, and the scale 42*m* may be located from the 6 o'clock position to the 8 o'clock position.

In the above-described respective embodiments, the unit of the elevation degree is m/sec, but may be feet/sec.

In the above-described respective embodiments, Arabic numbers such as the number "1" are arranged in the scale 42*p*, the scale 42*m*, and the scale 42*z*. However, the invention is not limited thereto. For example, Roman numbers or Chinese numbers may be arranged in the scale 42*p*, the scale 42*m*, and the scale 42*z*.

In the above-described respective embodiments, the number "0" for showing 0 is located in the scale 42*z* serving as the example of the fourth scale, but the symbol other than the number "0" may be located. For example, a symbol "•" for showing 0 may be located in the scale 42*z*.

In the above-described respective embodiments, as the example of the third indicating hand, the numerical value display short hand 32 and the numerical value display long hand 33 are used, but the third indicating hand may employ one indicating hand or three or more indicating hands.

In the above-described respective embodiments, the measurement result number color and the measurement result indicating hand color are the white colors. The time symbol color and the time indicating hand color are the orange colors, and the symbol background color is the black color. However, the invention is not limited thereto. Specifically, if the lightness difference between the measurement result number color and the symbol background color is greater than the lightness difference between the time symbol color and the symbol background color, any color may be used for the measurement result number color and the time symbol color. Alternatively, if the color difference between the measurement result number color and the symbol background color is greater than the color difference between the time symbol color and the symbol background color, any color may be used for the measurement result number color and the time symbol color. Similarly, if the lightness difference between the measurement result indicating hand color and the symbol background color is greater than the lightness difference between the time indicating hand color and the symbol background color, any color may be used for the measurement result indicating hand color and the time indicating hand color. Alternatively, if the color difference between the measurement result indicating hand color and the symbol background color is greater than the color difference between the time indicating hand color and the symbol background color, any color may be used for the measurement result indicating hand color and the time indicating hand color.

For example, in a case where the lightness of the measurement result number color is the same as the lightness of the symbol background color, the lightness difference between the measurement result number color and the symbol background color is the same as the lightness difference between the time symbol color and the symbol background color. However, even though the lightness of the measurement result number color is the same as the lightness of the symbol background color, if the color difference between the measurement result number color and the symbol background color is greater than the color difference between the time symbol color and the symbol background color, the electronic timepiece W enables the user to more easily view the number showing at least a portion of the measurement result which is more important than the time.

In the above-described respective embodiments, the shape of the display unit 10 is circular. However, the shape is not limited to circular. For example, the shape of the display unit 10 may be rectangular.

In the above-described respective embodiments, the number of the operation buttons belonging to the electronic timepiece W is not limited to three according to the above-described respective embodiments, but may be less than three or more than three. The arrangement of the operation buttons belonging to the electronic timepiece W is not limited to the position according to the above-described respective embodiments.

In the above-described respective embodiments, each position of the 6 o'clock side information display unit 20, the 10 o'clock side information display unit 40, the 2 o'clock side information display unit 30, and the date display unit is not limited to the position according to the above-described respective embodiments. At least one of the 10 o'clock side information display unit 40, the 2 o'clock side information display unit 30, and the date display unit 50 may be omitted.

In the above-described respective embodiments, the current position calculation unit 66 acquires the satellite signal from the GPS receiver 2. However, the current position calculation unit 66 may acquire the satellite signal from a positioning satellite of a global navigation satellite system (GNSS) other than the GPS or a positioning satellite other than the GNSS. For example, the current position calculation unit 66 may acquire the satellite signal from satellites of one, two or more systems among a wide area augmentation system (WARS), a European geostationary-satellite navigation overlay service (EGNOS), a quasi zenith satellite system (QZSS), a global navigation satellite system (GLONASS), GALILEO, and BeiDou navigation satellite system (BeiDou).

The invention may also be regarded as a computer program configured to cause the above-described electronic timepiece W to function as each unit of the above-described electronic timepiece W or a computer readable recording medium having the computer program recorded thereon. For example, the recording medium is a non-transitory recording medium. In addition to an optical recording medium such as a CD-ROM, any other known recording medium such as a semiconductor recording medium and a magnetic recording medium can be used. The invention is also specified as an indicating hand control method for controlling the indicating hand of the timepiece according to the above-described respective aspects.

The above-described respective embodiments are applied to the electronic timepiece. However, the above-described respective embodiments are also applicable to a mechanical timepiece. Specifically, the display unit 10 is applicable as a display unit of the mechanical timepiece. For example, the 10 o'clock side information display unit 40 may display the barometric pressure measured by an aneroid barometer.

The entire disclosure of Japanese Patent Application No. 2018-034337, filed Feb. 28, 2018 is expressly incorporated by reference herein.

What is claimed is:

1. A timepiece comprising:

a display unit including a first indicating hand and a dial so as to display a time, the dial having:

a first scale having a number for showing an absolute value of a positive numerical value within a plurality of numerical values indicated by the first indicating hand, the absolute value of the positive numerical value being not provided with a positive sign;

a second scale having a number for showing an absolute value of a negative numerical value within the plurality of numerical values indicated by the first indicating hand, the absolute value of the negative numerical value being not provided with a negative sign;

a first sign that is a single positive sign showing that the numerical value indicated by the first indicating hand is positive, a second sign that is a single negative sign showing that the numerical value indicated by the first indicating hand is negative, and a third scale for showing a plurality of 10 power law exponents indicated by a second indicating hand.

2. The timepiece according to claim 1, wherein a shortest distance from the first scale to the first sign is shorter than a shortest distance from the first scale to the second sign, and wherein a shortest distance from the second scale to the second sign is shorter than a shortest distance from the second scale to the first sign.

3. The timepiece according to claim 1, further comprising:

a barometric pressure sensor, wherein the first indicating hand indicates a variation per unit time in an altitude based on barometric pressure measured by the barometric pressure sensor by using the first scale or the second scale.

4. The timepiece according to claim 1, further comprising:

a barometric pressure sensor, wherein the first indicating hand indicates the first sign in a case where a variation per unit time in barometric pressure measured by the barometric pressure sensor is positive, and indicates the second sign in a case where the variation is negative.

5. The timepiece according to claim 1, wherein the dial has a reference value indicated by the first indicating hand, and wherein in a plan view in an axial direction of an indicating hand axle of the first indicating hand, a number showing the absolute value of the plurality of numerical values is disposed line-symmetrically with respect to a virtual straight line passing through the indicating hand axle of the first indicating hand and the reference value.

6. The timepiece according to claim 1, wherein the display unit includes the second indicating hand and a third indicating hand, wherein the dial has a fourth scale for showing the plurality of numerical values indicated by the third indicating hand, and wherein the third indicating hand indicates a value obtained by dividing a display target numerical value by the 10 power law exponents indicated by the second indicating hand, by using the scale for showing the plurality of numerical values indicated by the third indicating hand.

7. The timepiece according to claim 1, further comprising:

a sensor, wherein the display unit includes the second indicating hand, a scale for showing a plurality of time zones indicated by the second indicating hand, and a scale for showing the plurality of numerical values indicated by the second indicating hand, wherein the plurality of numerical values indicated by the second indicating hand are measurement results measured by the sensor, and wherein in a plan view in an axial direction of an indicating hand axle of the second indicating hand, the scale for showing the plurality of numerical values indicated by the second indicating hand is disposed between the indicating hand axle of the second indicating hand and the scale for showing the plurality of time zones.

8. The timepiece according to claim 1, further comprising:

a sensor, wherein a lightness difference between a color of a number showing some of measurement results measured by the sensor in symbols disposed in the timepiece and a background color of the symbols is greater than a lightness difference between a color of the symbol relating to the time in the symbols and the background color.

9. The timepiece according to claim 1, further comprising:

a sensor, wherein a color difference between a color of a number showing some of measurement results measured by the sensor in symbols disposed in the timepiece and a background color of the symbols is greater than a color difference between a color of the symbol relating to the time in the symbols and the background color.

10. The timepiece according to claim 1, further comprising:

a sensor, wherein a lightness difference between a color of a portion of the indicating hands relating to measurement results measured by the sensor in the indicating hands belonging to the timepiece and a background color of symbols disposed in the timepiece is greater than a lightness difference between a color of a portion of the indicating hands relating to the time in the indicating hands belonging to the timepiece and the background color.

11. The timepiece according to claim 1, further comprising:

a sensor, wherein a color difference between a color of a portion of the indicating hands relating to measurement results measured by the sensor in the indicating hands belonging to the timepiece and a background color of symbols disposed in the timepiece is greater than a color difference between a color of a portion of the indicating hands relating to the time in the indicating hands belonging to the timepiece and the background color.

* * * * *